United States Patent [19]

Evans et al.

[11] 4,351,994

[45] Sep. 28, 1982

[54] HIGH-VOLTAGE SWITCHGEAR

[75] Inventors: David M. Evans, Palantine; Roy T. Swanson, North Riverside, both of Ill.

[73] Assignee: S&C Electric Company, Chicago, Ill.

[21] Appl. No.: 136,632

[22] Filed: Apr. 1, 1980

[51] Int. Cl.[3] ..... H01H 3/32

[52] U.S. Cl. ..... 200/153 SC; 335/76

[58] Field of Search ..... 200/153 SC, 318, 308; 335/73, 74, 75, 76; 185/37, 39

[56] References Cited

U.S. PATENT DOCUMENTS

| | | | |
|---|---|---|---|
| 3,522,401 | 8/1970 | Stene | 200/153 SC |
| 3,600,538 | 8/1971 | Puzas | 200/153 SC |
| 3,980,977 | 9/1976 | Evans | 335/74 |
| 4,020,432 | 4/1977 | Erickson et al. | 200/153 SC |
| 4,237,357 | 12/1980 | Opfer | 200/153 SC |
| 4,253,003 | 2/1981 | Evans et al. | 200/153 SC |

*Primary Examiner*—John W. Shepperd

*Attorney, Agent, or Firm*—John D. Kaufmann

[57] ABSTRACT

Disclosed in a high voltage switch operating mechanism which utilizes energy stored in a spiral spring to drive the high voltage switches from either the open to the closed or the closed to the open position. The spring can be charged either by a manual tool or by an electric motor. The switch can be tripped by either electric or manual trip mechanisms. Manual and electric trip interlock assemblies are provided to prevent the switch operating mechanism from being tripped either manually or electrically while the spring is being charged. A mechanism is provided to prevent the charging of the spring by the electric motor when the manual tool is used to charge the spring. Another mechanism is provided to decouple the operating mechanism from the switch. To allow testing of the operating mechanism without change of the switch state. The decoupling mechanism locks the switch to its present position before the decoupling is complete allowing the energy in the operating spring to be dissipated.

29 Claims, 36 Drawing Figures

32
98
48
126
104
51
105
78
78
76
76
102
66
66
107
40
40
60
60
106
51
82
84
68
68
62
68
96
122
51
82
86
72
81
70
92
74
74
100

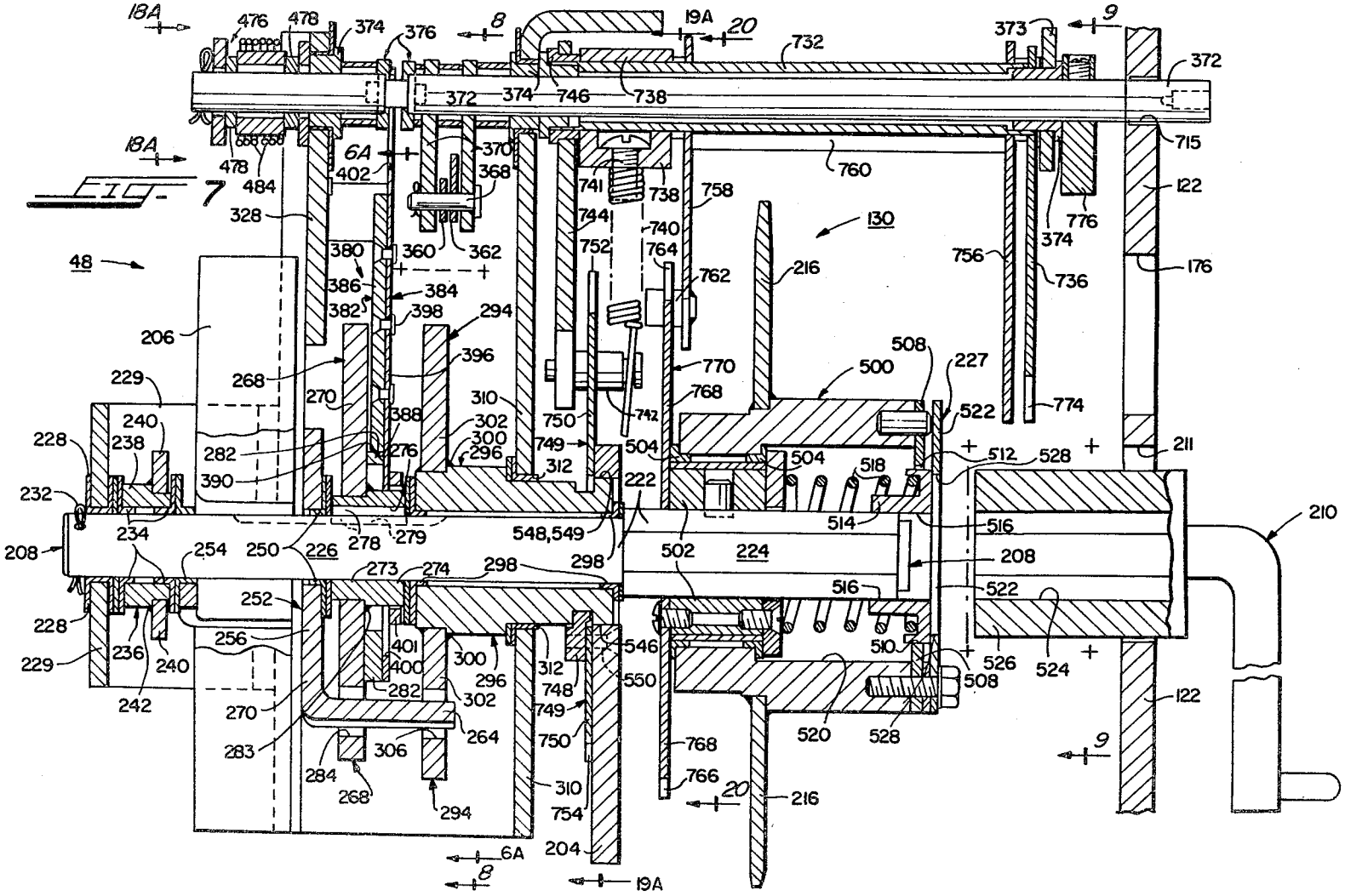

202
560
558
107
92
704
724
651
16A
650
612
562
630
568
570
600
200
602
566
564
588
96
62
81
568a
122
686
688
590
594
592
596
82
17A
578
584
620
570
632
682
652
678
668
568
658
624
679
664
700
582
580
576
674
660
574
572
568b
680
17A
657
656
16A
586
682
692
696
690
694

HIGH-VOLTAGE SWITCHGEAR

BACKGROUND OF THE INVENTION

The present invention relates to improved high-voltage switchgear, and more specifically, to metal-enclosed, two-way transfer switchgear which includes high-voltage switches, operating mechanisms for the switches, and high-voltage fuses, all in a metallic enclosure. The type of switchgear contemplated by the present invention includes one three-phase switch connectable to a preferred source of high-voltage electricity and another three-phase switch connectable to an alternate source of high-voltage electricity. Electrical power is supplied to electrical loads through high-voltage fuses connectable to the switches. Normally, the preferred source energizes the loads; should anything untoward occur with or in the preferred source, the switch associated therewith is opened and the switch associated with the alternate source is closed to disconnect the preferred source from the loads and to connect the alternate source to the loads through the fuses.

Various types of high-voltage switchgear which include stored-energy operating mechanisms for the switches thereof are well known, as exemplified by numerous, commonly-assigned U.S. Patents and Patent Applications set forth below. The present invention relates to improvements in such high-voltage switchgear. Specifically, according to various aspects of the present invention, the operating mechanisms for the switches may have mechanical energy stored therein either automatically, by a motor, or manually, by manipulation of a hand crank. The energy, once stored, may be either automatically released, in response to the condition of the preferred and alternate sources, or may be manually released, regardless of the condition of the sources at the option of operating personnel, to affect the condition of the switches. Each operating mechanism may be decoupled from its switch so that they may be exercised for maintenance or adjustment purposes without affecting the condition of the switches. The manual release of the energy stored in the operating mechanisms is prevented when energy is in the process of being stored therein by either the motor or the hand crank. Also, engagement of the hand crank with either operating mechanism preparatory to manually storing mechanical energy therein prevents its motor from attempting to store energy therein and also prevents automatic or manual release of any energy stored within the operating mechanism. Decoupling of the operating mechanisms from their switches causes the switches to be locked in their extant position at the time of decoupling and may also prevent automatic operation of the switchgear while such uncoupled condition exists, although manual operation may occur.

The improved switchgear also includes appropriate legends visible to operating personnel and informing whether mechanical energy is or is not stored within each operating mechanism, whether each operating mechanism is in the switch-closed or the switch-open position, whether or not each switch is closed or opened, and in what direction the hand crank must be rotated in order to manually store mechanical energy in each operating mechanism.

The above and other features of the present invention all serve to render the switchgear thereof improved from the standpoints of convenience of use, reliability and the safety of operating personnel. The present invention represents an improvement over various commonly-assigned U.S. Patents and Patent Applications, all cited hereinafter.

SUMMARY OF THE INVENTION

The present invention relates to improved high-voltage switchgear of the type which has a switch selectively operable between a closed position and an open position. The switchgear also has a switch-operating mechanism which can assume a switch-closed or a switch-opened condition due to the action of a facility therein which stores a predetermined amount of mechanical energy. The predetermined amount of stored energy is capable, upon the release thereof, of opening or closing the switch.

Improved high-voltage switchgear, according to the present invention, includes a first electrical facility which re-stores the predetermined amount of energy in the energy storing facility in response to, and after, the release of energy previously stored in the energy storing facility. The re-stored energy is capable of placing the operating mechanism in the condition opposite that it assumed during the release of the previously stored energy. A first mechanical facility is responsive to selective manual manipulation for re-storing the predetermined amount of energy in the energy storing facility. The first mechanical facility may be utilized after the release of energy previously stored in the energy storing facility so that the re-stored energy is capable of placing the operating mechanism in the condition opposite that which is assumed during the release of the previously stored energy.

A second electrical facility releases energy in the energy storing means in response to the condition of a circuit to which the switch is connected. A second mechanical facility releases the energy stored in the energy storing facility in response to selective manipulation thereof, regardless of the condition of the circuit.

A first preventing facility responds to the ongoing restoration of energy in the energy storing means by either the first electrical facility or the first mechanical facility. The first preventing facility prevents the release of any energy by the second mechanical facility until the predetermined amount of energy is re-stored. A second preventing facility responds to the ongoing restoration of energy in the energy storing means by the first mechanical facility to achieve two ends. First, the second preventing facility prevents the re-storing of energy in the energy storing facility by the first electrical facility. Second, the second preventing facility prevents the release of any energy in the energy storing facility by the second electrical facility. Both preventive steps are effected at least until the predetermined amount of energy is re-stored.

Preferred forms of the switchgear also include a coupling facility which responds to selective manual manipulation thereof for coupling the operating mechanism to, or decoupling the operating mechanism from, the switch. The coupling facility responds to the decoupling of the operating mechanism from the switch by dissipating any residual energy stored in the operating mechanism to prevent damage to the switch and to the operating mechanism by the residual energy. A facility responsive to an ongoing attempt to decouple the operating mechanism from the switch locks the switch in its extant position before decoupling is completed. This latter facility also responds to an ongoing attempt to couple the operating mechanism to the switch for unlocking the switch for movement by the operating mechanism out of its extant position after coupling has been completed.

DESCRIPTION OF THE DRAWING

FIG. 7 is a side elevational, partially sectioned view of a portion of the operating mechanism of FIGS. 5A, 5B, 6 and 6A taken generally along line 7—7 in FIG. 5B and depicting elements in addition to those shown in FIGS. 6 and 6A;

DETAILED DESCRIPTION

General—Switchgear 20 (FIGS. 1, 2, 3A and 3B, 4A and 4B)

Figure 1:
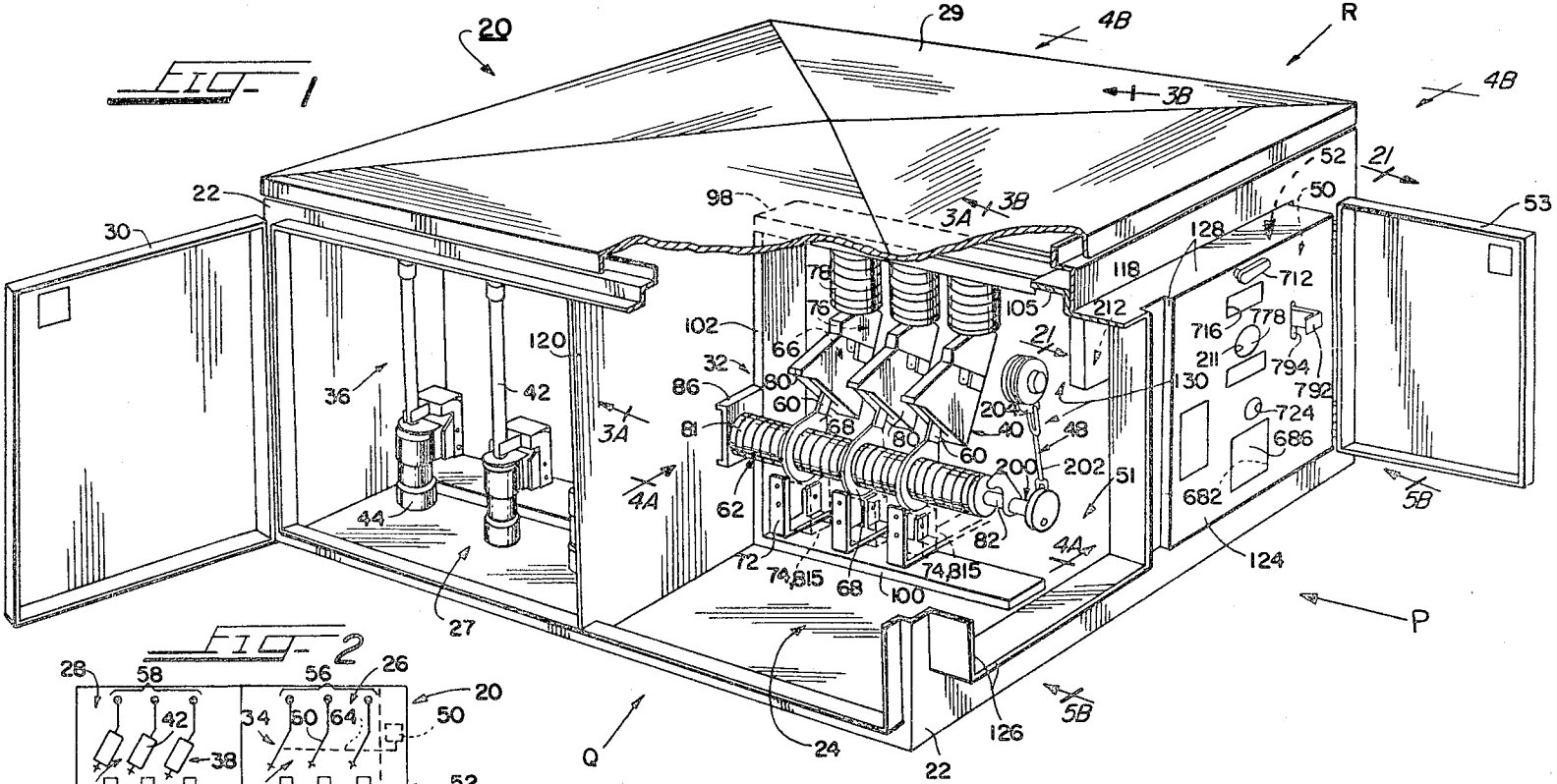
FIG. 1 is a perspective partially broken away, overall view of improved high-voltage switchgear according to the present invention.
Figure 2:
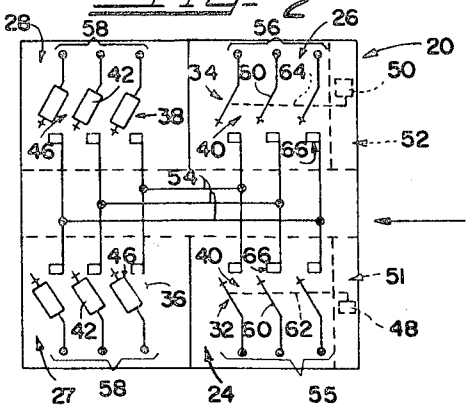
FIG. 2 is an electric schematic of the switchgear depicted in FIG. 1.

Referring first to FIGS. 1 and 2, there is shown a general, overall view and electrical schematic view of high-voltage switchgear 20 according to the present invention. The switchgear 20 includes a metal enclosure 22 which is divided into a pair of high-voltage switch compartments 24 and 26 and a pair of high-voltage fuse compartments 27 and 28. The enclosure 22 and a roof 29 therefor may take the forms depicted in commonly assigned U.S. Pat. Nos. 4,102,475, issued July 25, 1978 and 3,572,062, issued Mar. 23, 1971. The compartments 24, 26, 27 and 28 are closable by doors 30, only one of which for the fuse compartment 27 is shown. Viewing the switchgear 20 from a perspective along arrow "P" in FIGS. 1 and 2, the switch and fuse compartments 24 and 27 are referred to as the left-hand compartments, while the switch and fuse compartments 26 and 28 are referred to as the right-hand compartments.

Each switch compartment 24 and 26 may contain a three-phase, high-voltage switch assembly 32 and 34, while each fuse compartment 27 and 28 may contain a three-phase, high-voltage power fuse assembly 36 and 38. Each switch assembly 32 and 34 may include three similar interrupter switches 40, which preferably take the form depicted in commonly-assigned U.S. Pat. Nos. 4,169,973, issued Oct. 2, 1979, 3,676,629, issued July 11, 1972, and 3,549,840, issued Dec. 22, 1970. Each fuse assembly 36 and 38 may include three similar fuses 42 which have exhaust control devices 44 thereon and which are associated with integral load-break devices, only generally indicated at 46 in FIG. 2. The fuses 42 preferably take the form depicted in one or more of the following commonly-assigned U.S. Patents and patent application Nos.: D254,545, issued Mar. 25, 1980; 4,192,534, issued Mar. 11, 1980; 4,193,053, issued Mar. 11, 1980; 4,159,185, issued June 26, 1970; 4,158,830, issued June 19, 1979; 4,153,893, issued May 8, 1979;

4,103,270, issued July 25, 1978; 4,075,755, issued Feb. 28, 1978; 4,109,227, issued Aug. 22, 1978; 4,186,365, issued Jan. 29, 1980; 4,123,639, issued Oct. 31, 1978; 4,045,758, issued Aug. 30, 1977; Serial No. 837,246, filed Sept. 27, 1977; Serial No. 837,236, filed Sept. 27, 1977; Ser. No. 837,240, filed Sept. 27, 1977; Ser. No. 837,242, filed Sept. 27, 1977; and Ser. No. 741,027, filed Nov. 11, 1976. The exhaust control devices 44 preferably take the form depicted in one or more of the following commonly-assigned U.S. Pat. Nos.: 4,001,750, issued Jan. 4, 1977; 3,965,452, issued June 22, 1976; 3,391,368, issued July 2, 1968; 3,965,452, issued June 22, 1976; 3,719,912, issued Oct. 26, 1973; and 3,230,331, issued Jan. 18, 1966. The integral load break devices 46 preferably take the form depicted in one or more of the following commonly-assigned U.S. patent applications: Ser. No. 660,872, filed Feb. 24, 1976; Ser. No. 901,966, filed May 1, 1978; Ser. No. 901,964, filed May 1, 1978; Serial No. 901,965, filed May 1, 1978; and Ser. No. 901,968, filed May 1, 1978. The individual switches 40 of each switch assembly 32 and 34 are preferably gang-operable (i.e., simultaneously) by similar operating mechanisms 48 and 50 contained in separate compartments 51 and 52 in the enclosure 22 and closable by doors 53, only one of which is shown in FIG. 1. The operating mechanisms 48 and 50 are improvements, according to the present invention, of the general type of mechanisms depicted in the following commonly-assigned U.S. Patents and patent application Nos.: 3,980,977, issued Sept. 14, 1976; 3,898,420, issued Aug. 5, 1975; 3,563,102, issued Feb. 16, 1971; Ser. No. 911,123, filed May 31, 1978; Ser. No. 922,326, filed June 6, 1978; and Ser. No. 26,867, filed Apr. 4, 1979.

As schematically shown in FIG. 2, the switches 40 and the fuses 42 may be interconnected by appropriate buses, generally shown at 54, contained within the enclosure 22. As explained more fully below, the switches 40 in the left-hand compartment 24 may be manually or automatically opened or closed by the operating mechanism 48, and the switches 40 in the right-hand compartment 26 may be manually or automatically opened or closed by the operating mechanism 50. The switches 40 in both compartments 24 and 26 may be open; however, if the switches 40 in one compartment are closed, the switches 40 in other compartment must be open. The fuses 42 in both compartments 27 and 28 may be selectively and individually manually opened or closed.

Still referring to FIG. 2, the switches 40 of the switch assembly 32 in the left-hand compartment 24 may be electrically located between a preferred three-phase voltage source, generally indicated at 55, and the buses 54. The switches 40 of the switch assembly 34 in the right-hand compartment 26 may be electrically located between an alternate three-phase voltage source, generally indicated at 56, and the buses 54. Thus, the switches 40 of the assembly 32 are normally closed, connecting the preferred source 55 to the buses 54, and the switches 40 of the assembly 34 are normally open. If the preferred source 55 is lost, the switches 40 of the assembly 32 may be opened and the switches 40 of the assembly 34 closed to connect the alternate source 50 to the buses 54. The fuses 42 in both compartments 27 and 28 may be electrically located between the buses 56 and electrical loads, generally indicated at 58. Thus, the loads 58 may receive electrical power from either source 55 or 56 (but not from both sources at the same time), depending on which switches 40 of which assembly 32 or 34 are closed and which fuses 42 are closed. Accordingly, the switchgear 20 may be designated as "two way transfer" gear. The integral load-break devices 46 permit the fuses 42 to be individually opened while the loads 58 connected thereto are energized by one of the sources 55 or 56.

Further details of the enclosure 22, the fuse compartments 27 and 28, the fuse assemblies 36 and 38, the fuses 42, the exhaust control devices 44 and the load-break devices 46 are not set forth herein, as these items only generally form a part of the present invention.

General—Switch Assemblies 32 and 34

Referring now to FIGS. 1, 2, 3A and 3B, 4A and 4B, each switch 40 of the assemblies 32 and 34 includes a switch blade 60. The blade 60 of each assembly 32 and 34 are respectively commonly rotatable by common insulative struts 62 and 64 into and out of engagement with respective stationary contact assemblies 66. The struts 62 and 64, as explained below, are respectively, selectively rotated by the operating mechanisms 48 and 50. Each strut 62 and 64 mounts three conductive blade-mounting members 68 to which the lower ends of the switch blades 60 are respectively mechanically and electrically connected. The members 68 are in continuous, sliding, electrical engagement with respective contact assemblies 70. The contact assemblies 70 and respective electrically interconnected terminals 72 therefor are mounted to an insulator 74 which may be a part of an integral voltage sensor (not shown) and insulator described in commonly-assigned U.S. Pat. No. 4,002,976, issued Jan. 11, 1977. Attachable to each terminal 72 is a cable (not shown) which is connectable in one of the sources 54 or 56.

Each stationary contact assembly 66 depends from a support member 76, which in turn depends from an insulator 78. Each support member 76 is connectable to an appropriate one of the buses 54. Each blade 60 moves into and out of engagement with its stationary contact assembly 66 through a passage (not numbered) formed in an arc-compressing chute 80 (FIG. 1; shown in phantom in FIG. 3; not shown in FIGS. 4A and 4B) mounted to the support member 76. Clockwise rotation of the strut 62 (FIGS. 1 and 3A) closes the switches 40 in the compartment 24 and counterclockwise rotation of the strut 62 (FIG. 3B) opens these switches 40. Counterclockwise rotation of the strut 64 closes the switches 40 in the compartment 26 and clockwise rotation of the strut 64 opens them.

Figure 4A:
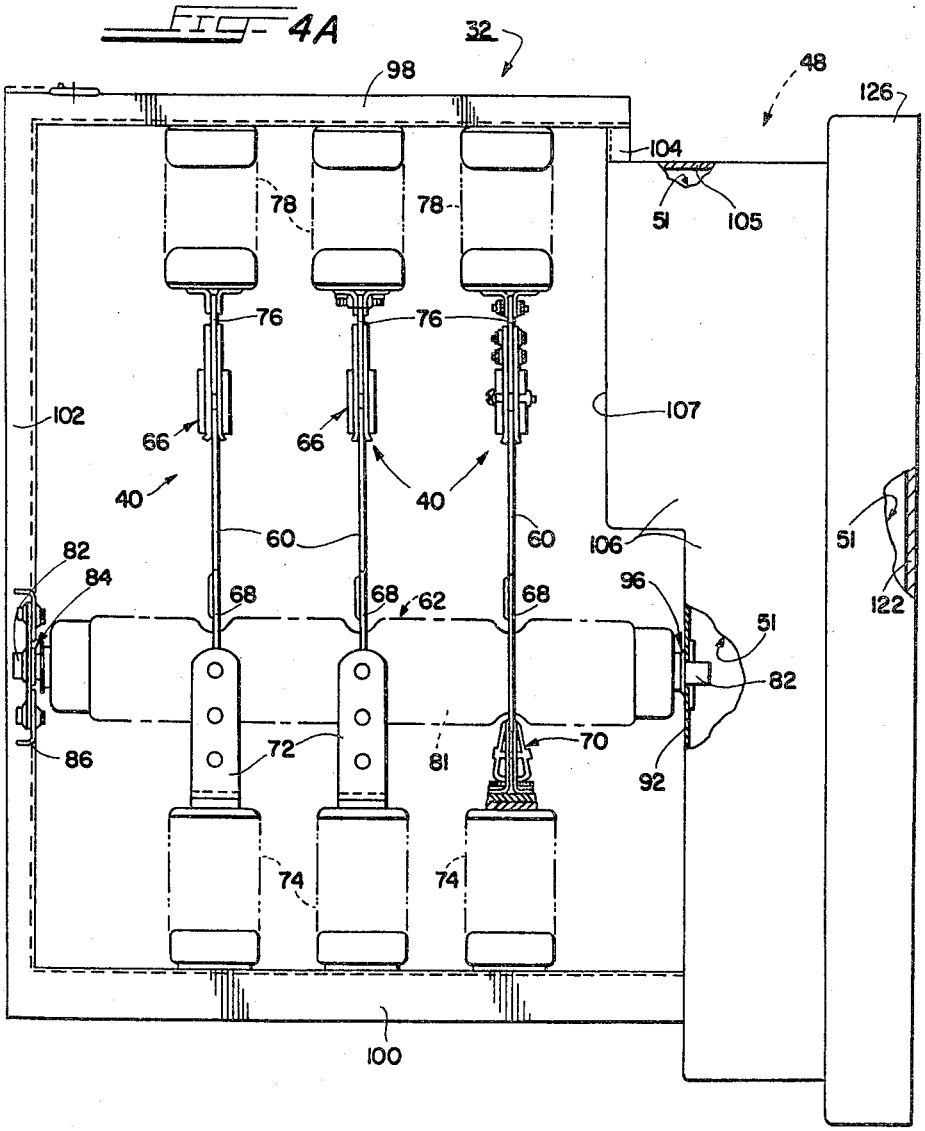
FIGS. 4A and 4B are respective front elevations of the switches of FIGS. 3A and 3B within the switchgear of FIG. 1 taken generally along lines 4A—4A and 4B—4B in FIG. 1.

Referring to FIGS. 1, 4A nd 4B, the insulative struts 62 and 64 may be seen to include elongated, skirted, insulative bodies 81 molded from a cycloaliphatic resin or the like. During the molding of the strut bodies 81, there are molded thereinto at either end splined studs 82. The strut 62 is rotatably mounted in the compartment 24 by means of the studs 82.

Specifically, the left-hand stud 82 (FIG. 4A) of the strut 62 is rotatably carried by a bearing assembly 84, which is in turn carried by a generally U-shaped support member 86. The right-hand stud 82 (FIG. 4B) of the strut 64 in the compartment 26 is carried by a similar bearing assembly 84 and support member 86. The right-hand stud 82 of the strut 62 extends into the compartment 51 which houses the operating mechanism 48 and is connected to the operating mechanism 48 for rotation thereby in a manner to be described below. The left-hand stud 82 of the strut 64 similarly extends into the compartment 52 for selective rotation by the operating mechanism 50. Both the right-hand stud 82 of the strut 62 and the left-hand stud 82 of the strut 64 extend through respective lower side walls 92 and 94 of the compartments 51 and 52. Such studs 82 are supported for rotation by appropriate bearing assemblies generally indicated at 96.

The switches 40 in the compartments 24 and 26 are assembled in back-to-back fashion, each assembly 32 and 34 serving as a unitary subassembly of the switchgear 20 and being mountable within the metal enclosure 22.

Figure 4B:
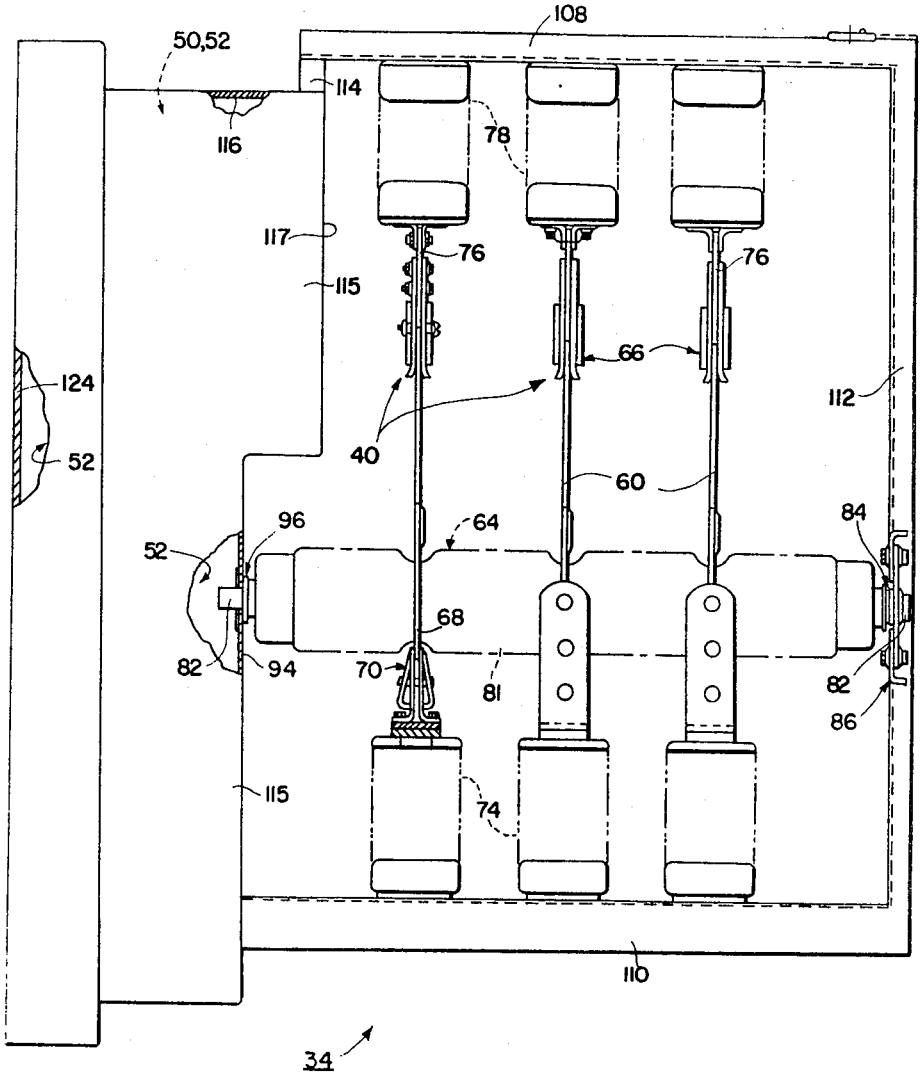

Referring to FIGS. 4A and 4B, the left-hand switch assembly 32 may be seen to comprise an upper channel member 98 from which depend the insulators 78. The assembly 32 also includes a lower channel member 100 which supports the insulators 74. At the left side of the assembly 32, the channel members 98 and 100 are maintained rigidly apart by a side channel member 102. The side channel member 102 may be attached to the channel members 98 and 100 by welding or the like. Further, the U-shaped support member 86 for the left-hand stud 82 of the strut 62 may be mounted to the side channel member 102 by welding (see also FIG. 1). The assembly 32 also includes a short, right-side channel member 104. The right-hand side of the assembly 32 may be rigidly fixed in the enclosure 22 by welding the short channel member 104 to the outside of a top wall 105 and the lower channel member 100 to the outside of the lower side wall 92 defining the compartment 51 for the operating mechanism 48. In FIG. 4A, there are shown the lower side wall 92, the top wall 105, a front wall 106, and an upper side wall 107 of the compartment 51, it being understood that the compartment 51 is preferably totally enclosed by a number of additional walls fastened together by welding or the like. It should be noted that the assembly 32, as shown in FIG. 4A, is depicted as though viewed from a perspective along an arrow "Q" of FIG. 1.

The assembly 32 is quite similar to, but is the mirror image of, the assembly 32, as shown in FIG. 4B. In FIG. 4B, the assembly 34 is depicted as though viewed from a perspective along an arrow "R" in FIG. 1 and includes an upper channel member 108 and a lower channel member 110 (both respectively similar to the upper channel member 98 and the lower channel member 100), a right-side channel member 112 similar to the left-side channel member 102, and a short left-side channel member 114 similar to the short right-side channel member 104. The compartment 52 includes a front wall 115, a top wall 116, an upper side wall 117, and the lower side wall 194, all similar to their corresponding elements 106, 105, 107 and 92, defining the compartment 52 within which is located the operating mechanism 50. FIG. 3 depicts both in section and in phantom some of the structural elements 98–117 shown in FIGS. 4A and 4B. The upper channel member 98 and 108 may be connected as by welding between frame members 118 of the metal enclosure 22 (see FIG. 3). Further, the lower channel member 100 and 110 may be respectively connected between the lower side walls 92 and 94 of the compartments 51 and 52 and interior side walls 120 of the enclosure 22.

Figure 3A:
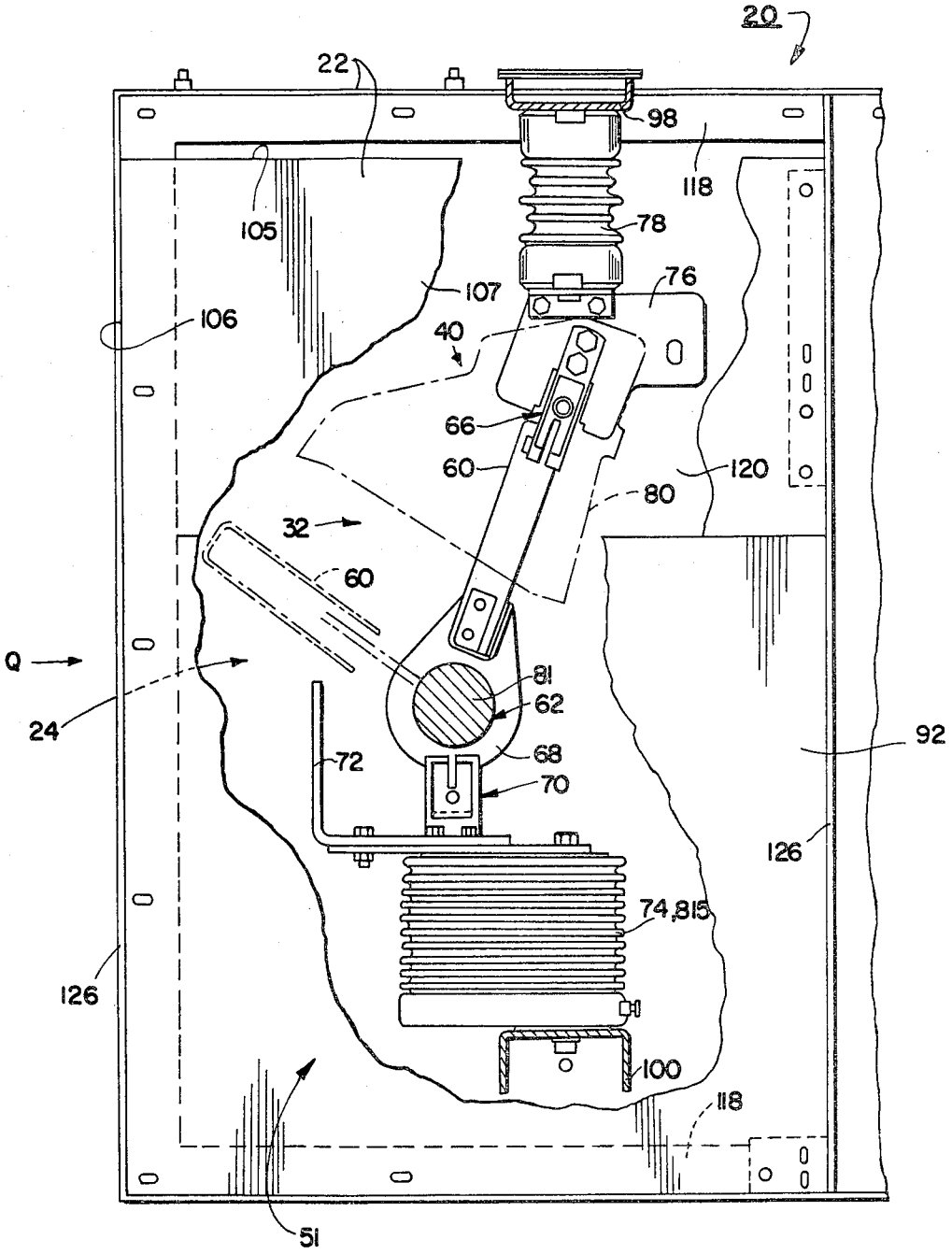
FIGS. 3A and 3B are, respectively, side, elevational, partially sectioned views of switches contained within the switchgear of FIG. 1 taken generally along lines 3A—3A and 3B—3B in FIG. 1 with portions of walls broken away.
Figure 3B:
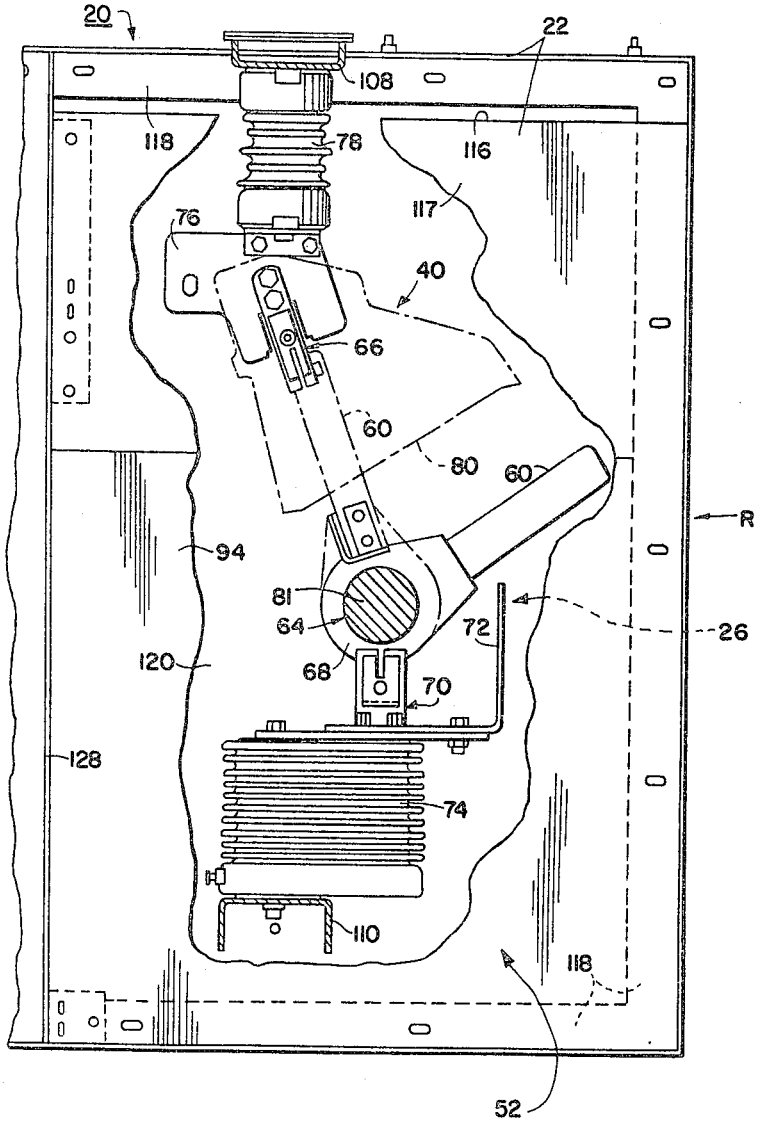

Thus, each assembly 32 and 34 may separately be constructed and assembled as shown in FIGS. 4A and 4B, and following such construction and assembly, appropriately inserted into and mounted within the enclosure 22 as depicted in FIGS. 1, 3A and 3B. Moreover, each assembly 32 and 34, with or without the compartments 51 and 52, may be sold as shown in FIGS. 4A and 4B, apart from the enclosure 22 and the operating mechanisms 48 and 50, for use with the switch assemblies 32 and 34, which may be provided by the purchaser and placed in the compartments 51 and 52.

Continuing to refer to FIGS. 1, 3A and 3B, 4A and 4B, after the assemblies 32 and 34 are installed in the enclosure 22, the compartments 51 and 52 for the operating mechanisms 48 and 50 are located side-by-side as shown in FIGS. 1 and 3. In addition to the walls 95, 105, 106 and 107 of the compartment 51, and to the walls 94, 115, 116 and 117 of the compartment 52, the compartments 51 and 52 may be enclosed by respective exterior walls 122 and 124 so that most of the mechanisms 48 and 50 are not normally accessible. Outwardly extending frames 126 and 128 rim the walls 122 and 124. It is against these frames 126 and 128 that the doors 53 may be closed. Opening the doors 53 exposes various controls and indicators for the operating mechanisms 48 and 50, as described below, which controls and indicators are on the outside of, or are accessible through the walls 122 and 124.

Operating Mechanisms 48 and 50

Figure 5A:
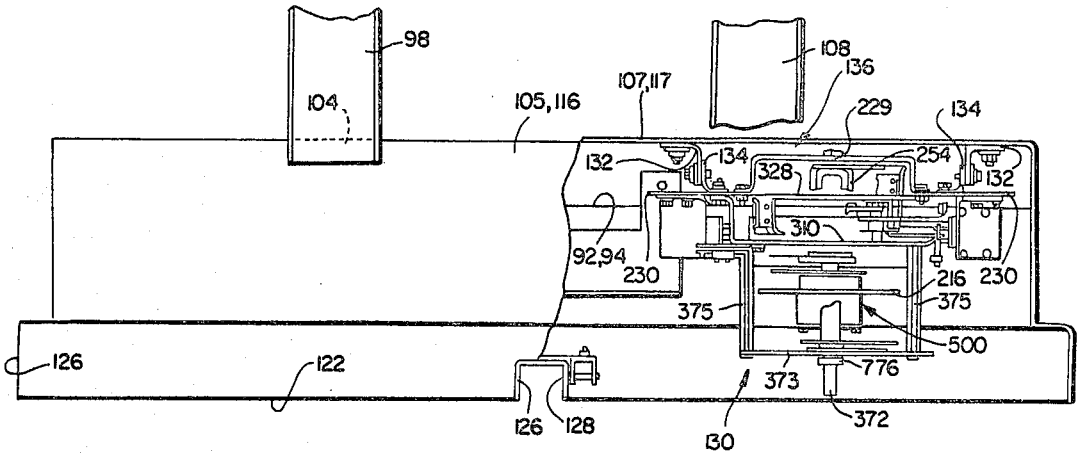
FIG. 5A is a top, partial plan view of a portion of an operating mechanism in a compartment for the switches of previous Figures taken generally along line 5A—5A in FIG. 5B with portions of walls of the compartment partially broken away.

Referring first to FIG. 5A, there is shown a top view of a portion of the operating mechanism 50 within its compartment 52. As depicted, the top walls 105 and 116 may be integral and continuous as may the lower side walls 92 and 94 and the upper side walls 107 and 117. The operating mechanisms 48 and 50 each include similar quick-break/quick-make mechanisms 130 which rapidly open and close the switches 40 by rapidly rotating the switch blades 60. The quick-break/quick-make mechanisms may be supported by brackets 132 and 134, the former being attached to the upper side walls 107 and 117 in any convenient manner. The brackets 134 are attached between the brackets 132 and a main frame 136 for the mechanisms 130.

Figure 5B:
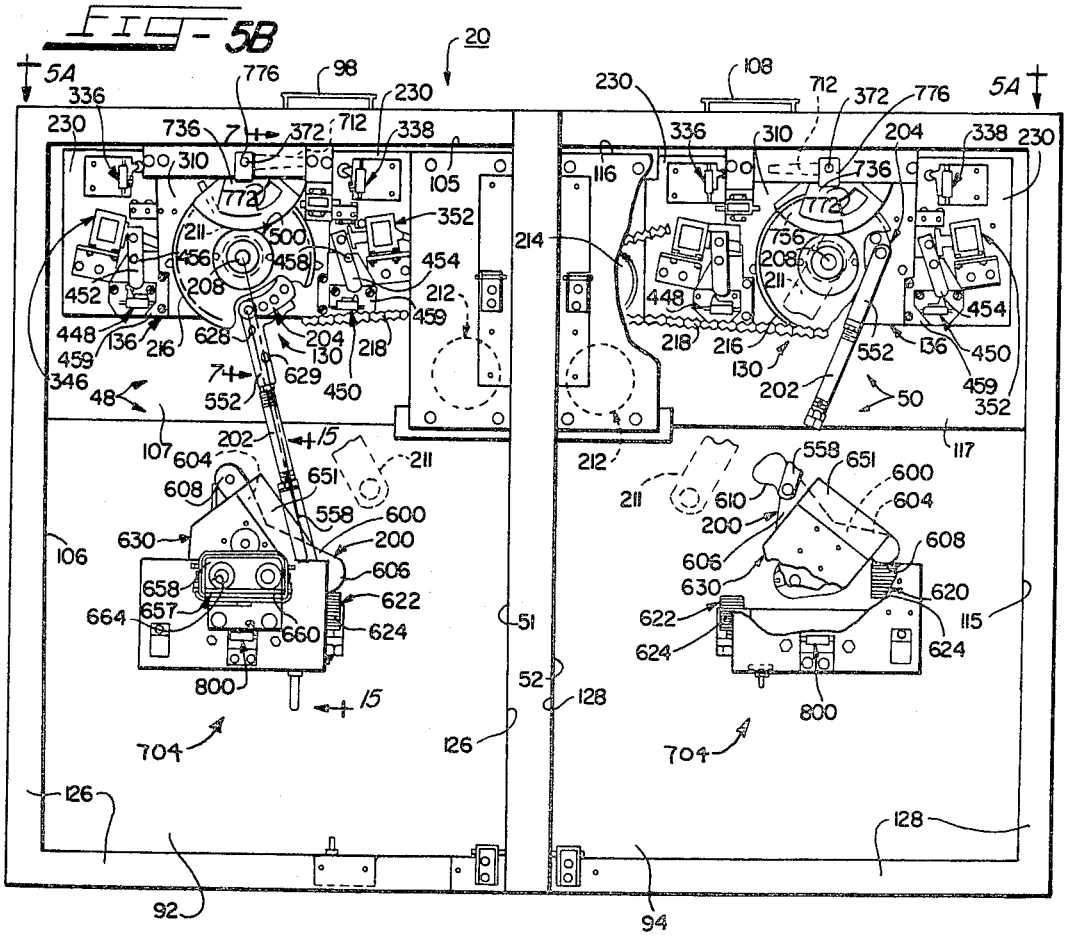
FIG. 5B is a partial, partially sectioned, front elevational view of portions of operating mechanisms for the switches of previous Figures taken generally along line 5B—5B in FIG. 1 with certain walls of FIG. 1 being removed.

Referring now to FIG. 5B, there are generally depicted the operating mechanisms 48 and 50 taken from generally the same aspect as in FIGS. 3A and 3B, that is, from the aspect of the arrow "P" in FIGS. 1, 4A and 4B with the exterior side walls 122 and 124 removed. As can be seen, FIG. 5B represents a view of the operating mechanisms 48 and 50 within their respective compartments 51 and 52, the respective upper and lower side walls 107, 117 and 92, 94 of which are also seen. It should be understood that the majority of the elements depicted in FIG. 5B are not normally exposed or accessable as shown in that Figure, the compartments 51 and 52 being normally closed by the walls 122 and 124 which are appropriately attached to the frames 126 and 128. As viewed in FIG. 5B, the operating mechanisms 48 and 50 contain numerous similar elements and in the general description relating to FIG. 5B, the same reference numerals are utilized for corresponding elements of both mechanisms 48 and 50. Specifics of the operating mechanisms 48 and 50 depicted only generally in FIG. 5B are shown in detail in FIGS. 6–21, to which reference should also be made.

The struts 62 and 64 are rotated by rotatable drive levers 200 connected to the studs 82 in a manner described below (see generally FIG. 1). The drive levers 200 are, in turn, rotated by reciprocation of push-pull rods 202. The push-pull rods 202 are reciprocated by the selective rotation of first output levers 204 which are connected to the push-pull rods 202 in a manner described below. As viewed in FIG. 5B, counterclockwise rotation of the drive and output levers 200 and 204 of the operator 48 and upward movement of the push-pull rod 202 opens the switches 40 in the left-hand compartment 24. Clockwise rotation of these levers 200 and 204 and downward movement of the rod 202 to the positions shown in FIG. 5B close the switches 40 in the compartment 24. Clockwise rotation of the output lever 204, downward movement of the rod 202, and counterclockwise rotation of the drive lever 200 of the operating mechanism 50 closes the switches 40 in the right-hand compartment 26. Counterclockwise rotation of the output lever 204, upward movement of the rod 202 and clockwise rotation of the drive lever 200 to the positions in FIG. 5 open the switches 40 in the compartment 26. The output levers 204 are selectively, rapidly rotated by the rapid release of energy stored in spiral springs 206 of the quick-break/quick-make mechanism 130 for each operator 48 and 50, as more clearly depicted in FIGS. 6, 6A, 6B and 7. It should be noted that FIGS. 6–21 depict only one of the operating mechanisms 48, it being understood that the operating mechanism 50 contains similar elements which are similarly interrelated.

Referring to FIGS. 1 and 5A–13, energy may be stored in each spring 206 (FIG. 6) in one of two ways. First, an input shaft 208 may be manually rotated by a hand crank 210 coupled directly thereto following insertion through holes 211 formed through the exterior side walls 122 or 124 of the compartments 51 and 52 see FIGS. 1 and 7. Second, the shaft 208 may be rotated by a motor 212 (FIG. 1) contained within each compartment 51 and 52. Rotation of the input shaft 208 in either way charges the spring 206 and stores energy therein in a manner to be described below. When the motor 212 rotates the input shaft 208, it does so via a first sprocket 214 (FIG. 5B) driven by the motor 212 through a gear box. The sprocket 214 is connected to a second sprocket 216 (FIGS. 5B and 7) by a chain 218. As described in more detail below, the second sprocket 216 is selectively coupleable to the input shaft 208. The second sprocket 216 is normally coupled to the input shaft 208, being uncoupled therefrom only when the hand crank 210 is coupled to the input shaft 208.

Referring to FIG. 7, the output lever 204, the spiral spring 206, and the input shaft 208 are all elements of the respective quick-break/quick-make mechanisms 130 of the operating mechanisms 48 and 50. The input shaft 208 comprises an elongated member 222, a forward portion 224 of which has a hexagonal cross-section, and a rearward portion 226 of which has a circular cross-section. The forward portion 224 of the input shaft 208 is engageable, via the holes 211 through the exterior side walls 122 and 124 of the compartments 51 and 52 by the hand crank 210. The hexagonal forward portion 224 is also selectively engageable by a clutch facility 227 associated with the second sprocket 216, as described more fully below. The rearward portion 226 of the input shaft 208 is journaled for rotation by means of appropriate bearings 228 in a structural support member 229 which may be mounted, via support plates 230 and the brackets 132 and 134 (FIG. 5A) to the upper side wall 107 and 117 of the compartments 51 and 52. The support plates 230, which are directly mounted to the brackets 134, and the support member 229 constitute a portion of the main frame 136. A cotter key 232 or the like may prevent the input shaft 208 from being pulled away from the structural support member 229.

Figure 6:
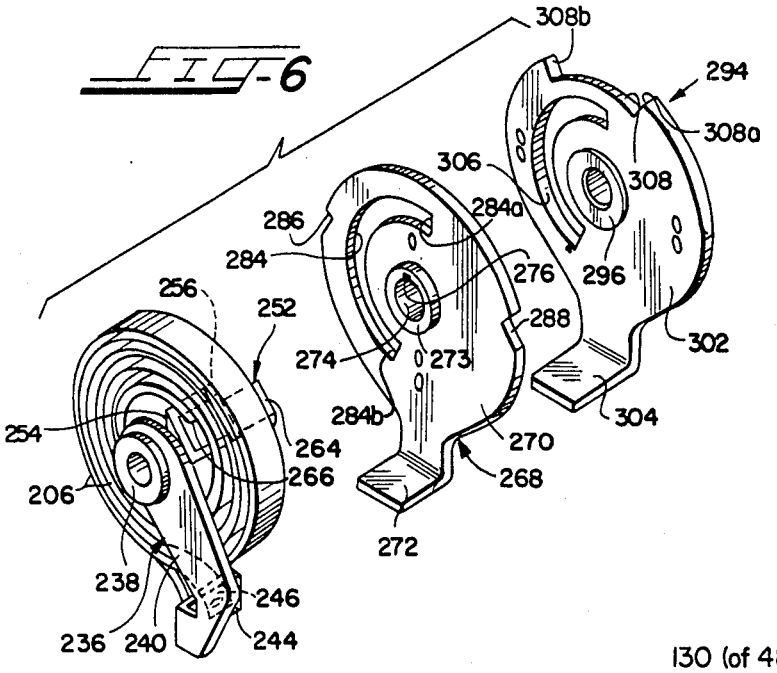
FIG. 6 is a perspective, exploded view of a portion of the operating mechanism shown in FIGS. 5A and 5B.
Figure 6A:
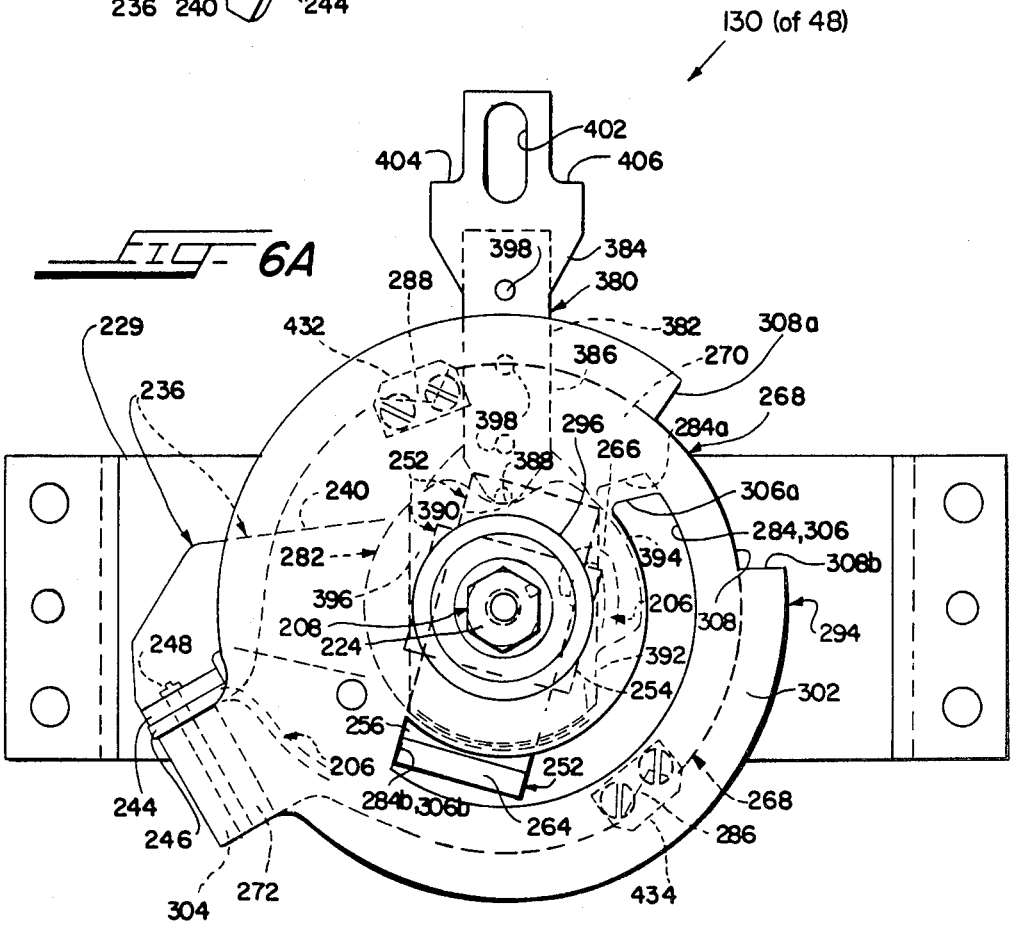
FIG. 6A is a front elevation of a portion of the operating mechanism of FIGS. 5A and 5B taken generally along line 6A—6A of FIG. 7 and with elements in addition to those in FIG. 6 being depicted.
Figure 8:
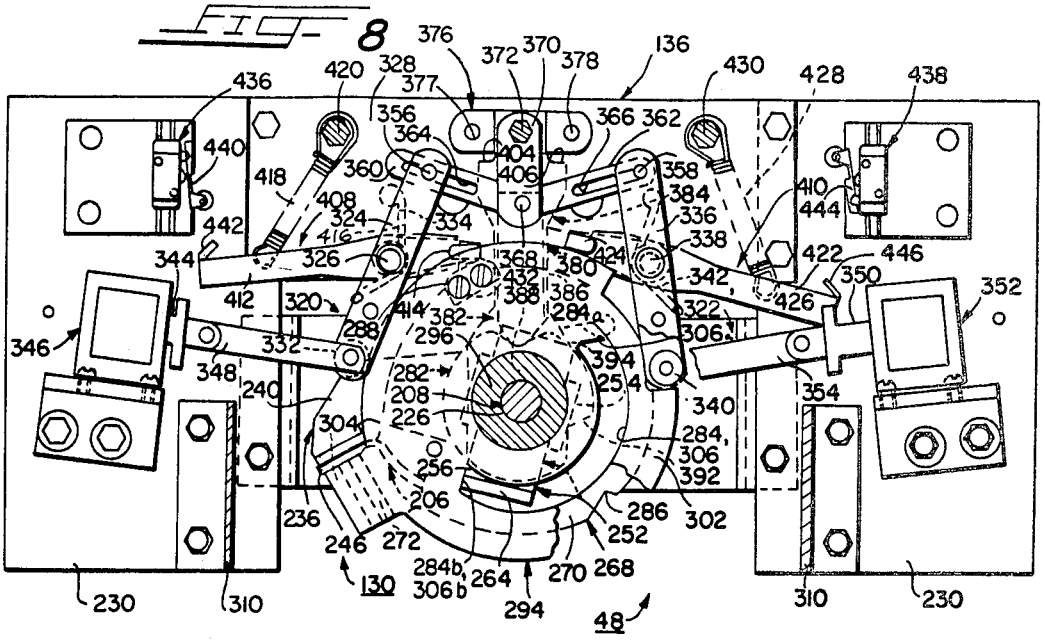
FIG. 8 is a front elevation of the operating mechanism depicted in FIG. 7 taken along line 8—8 therein.
Figure 9:
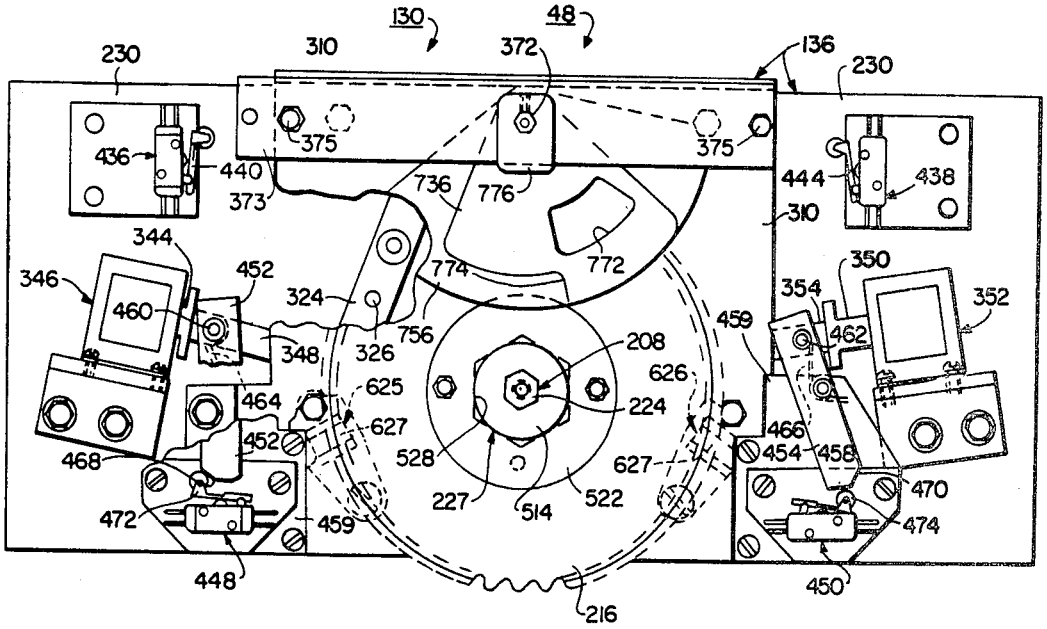
FIG. 9 is a front elevation of the operating mechanism of FIG. 7 taken along line 9—9 therein.
Figure 10A:
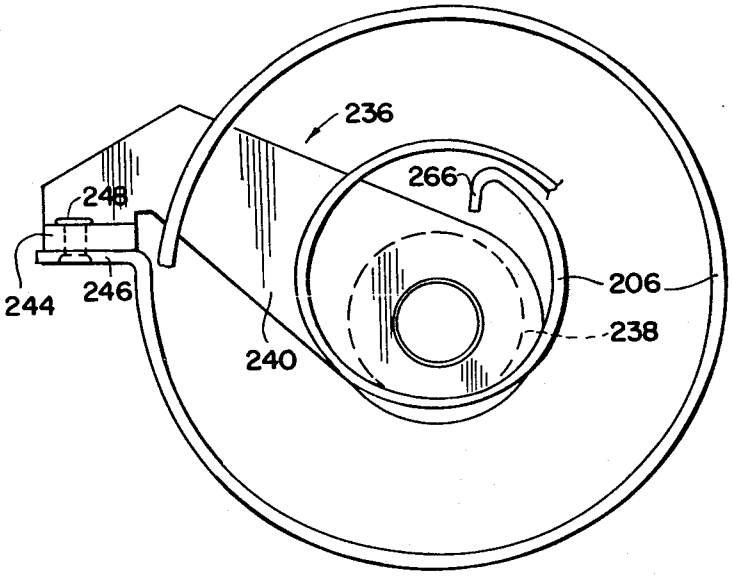
FIGS. 10A and 10B are, respectively, a front elevation and a top plan view of an outer spring arbor for the operating mechanism of FIG. 6.
Figure 10B:
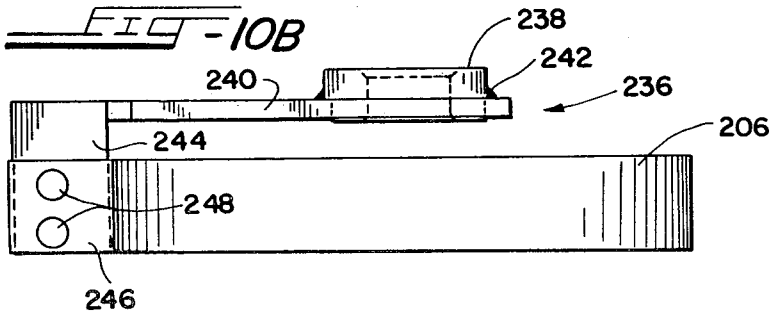

Referring to FIGS. 6–10, freely rotatable about the rearward portion 226 of the input shaft 208, via appropriate bearings 234 surrounding the input shaft 208, is an outer spring arbor 236 (FIG. 10). The outer spring arbor 236 comprises a cylindrical bushing-like member 238 surrounding the input shaft 208 and an arm 240 which extends generally transversely away from the input shaft 208 and which is attached to the member 238 by welding or the like indicated 242. The arm 240 includes an integral tang 244 parallel to the input shaft 208 which extends forwardly (FIGS. 6 and 6A). As viewed in FIGS. 5B, 6A and 8–10, the spiral spring 206 is a clockwise spiral about the input shaft 208 from its inside to its outside. An outside end 246 of the spring 206 is formed outwardly and transversely to the input shaft 208, as shown in FIGS. 6A and 10. The outside end 246 of the spring 206 is attached to the tang 244 of the arm 240 by rivets 248 or other appropriate fasteners.

As viewed in FIGS. 5B, 6A and 8–10, if the inside end of the spring 206 is held and the outer spring arbor 236 is rotated clockwise about the input shaft 208, energy is stored in the spring 206 tending to move the inside of the spring 206 clockwise and the outside end 246 of the spring 206 counterclockwise. Similarly, if the outer spring arbor 236 is held and the inside of the spring 206 is rotated counterclockwise, energy is stored in the spring 206 tending to rotate the inside end of the spring 206 clockwise and the outside end 246 of the spring 206 and the outer arbor 236 counterclockwise.

Figure 11B:
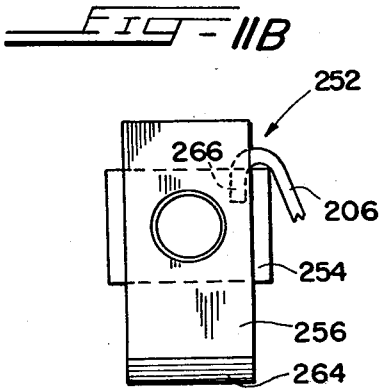
FIGS. 11A and 11B are, respectively, a side elevation and a front elevation of an inner spring arbor for the operating mechanism of FIG. 6.
Figure 11A:
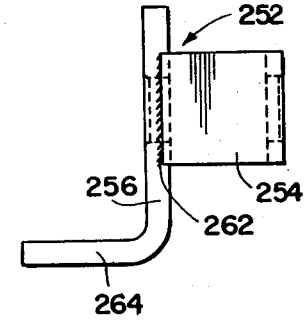

Also mounted for free rotation about the rearward portion 226 of the input shaft 208 via appropriate bearings 250 (FIG. 7) is an inner spring arbor 252 (FIG. 11). As best seen in FIGS. 6 and 11, the inner spring arbor 252 comprises two members: 254 and 256. The member 254 is U-shaped, the intermediate portion of the U surrounding the rearward portion 226 of the input shaft 208 via a rearward bearing 250. The arms of the U 254 extend forwardly through the spring 206. The member 256 is an arm which surrounds the rearward portion 226 of the input shaft 208 via a forward bearing 250 and extends transversely of the input shaft 208. As best shown in FIG. 11, the U-shaped member 254 is attached to the arm 256 by welding or the like, as shown at 262. The arm terminates in a forwardly extending tang 264 parallel to the input shaft 208. An inside end 266 of the spring 206 is looped around and attached to one arm of the U-shaped member 254, as best shown in FIGS. 6A and 11. If one of the arbors 236 or (252) is held while the other arbor 252 (or 236) is rotated about the input shaft 208 so as to store energy in the spiral spring 206, the held arbor 263 (or 252) when released tends to "follow" the rotated arbor 252 (236) as the stored energy is released from the spring 206.

Figure 12A:
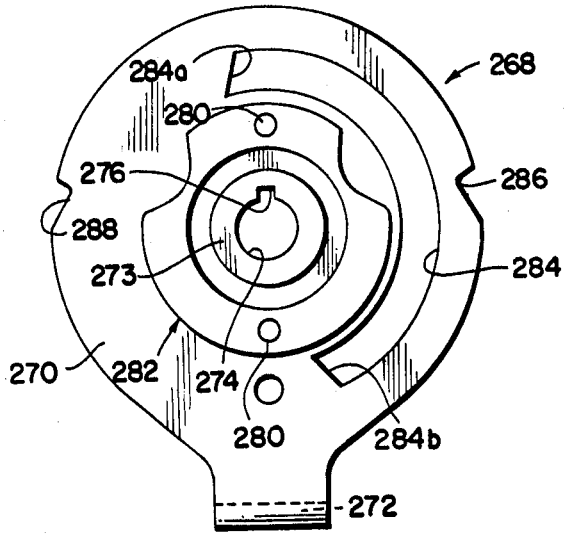
FIGS. 12A and 12B are, respectively, a front elevation and a side partially sectioned elevation of an input lever for the operating mechanism of FIG. 6.
Figure 12B:
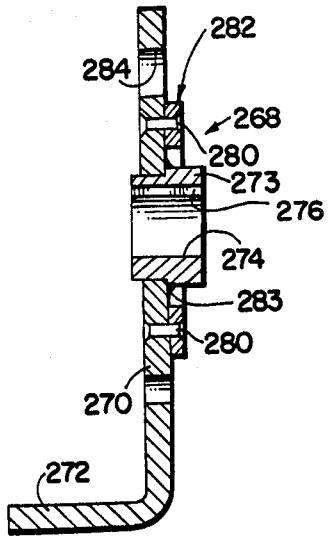
Figure 13A:
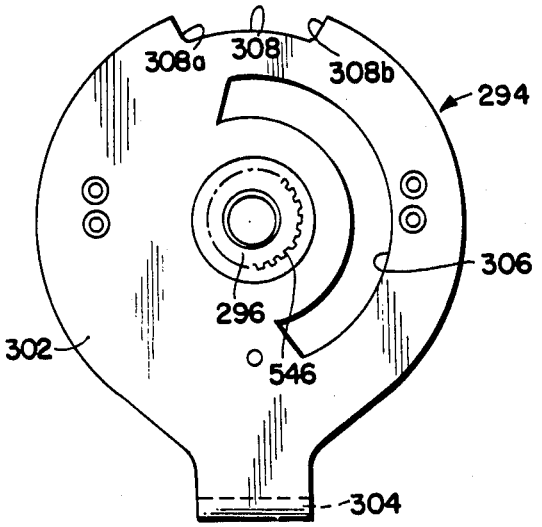
FIGS. 13A and 13B are, respectively, a front elevation and a side, partially sectioned elevation of an output lever for the operating mechanism of FIG. 6.
Figure 13B:
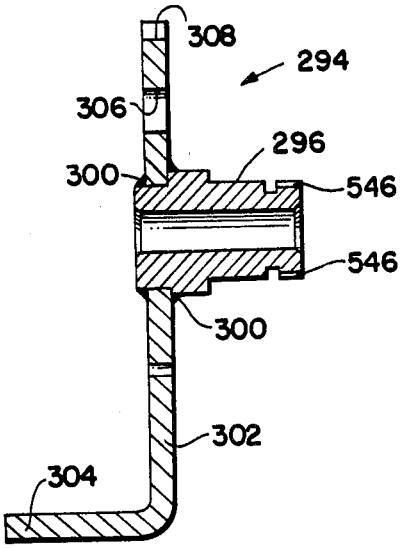

An input level 268, as best shown in FIGS. 6, 6A, 7, 8 and 12, comprises a main, generally circular body portion 270 transversely mounted to the input shaft 208 and having a rearwardly extending tang 272 (FIGS. 6, 6A and 12) which extends generally parallel to the input shaft 208. The body portion 272 includes a bushing 273 containing a central hole 274 having a keyway 276. The hole 274 surrounds the rearward portion 226 of the input shaft 208 and a key 278 (FIG. 7) located in the keyway 276 and a keyway 279 in the rearward portion 226 locks the bushing 273 to the input shaft 208. Attached to the body 270 by rivets 280 or other appropriate fasteners is a cam member 282 (FIGS. 7 and 12) serving a function described below. The bushing 273 is fixed to the body portion 270 by welding or the like, as shown at 283. Thus, the input lever 268, the cam 282 and the input shaft 208 rotate conjointly. Formed through the body portion 270 is an arcuate slot 284 which has ends 284*a* and 284*b*, as best shown in FIG. 12. Formed in the periphery of the main body portion 270 are notches 286 and 288. The notch 286 is located generally on a radius of the body 270 which bisects the slot 284 while the notch 288 is located counterclockwise from the notch 286 by an angle of approximately 150°. The slot 284 subtends an angle about the hole 274 of approximately 180°. As explained in more detail below and as shown in FIGS. 6, 6A, 7 and 8, the tang 264 of the inner spring arbor 252 extends forwardly through the slot 284 for a purpose to be described below.

Referring now to FIGS. 6, 6A, 7, 8 and 13, the quick-break/quick-make mechanism 130 includes a second output lever 294. The second output lever 294 comprises a hub 296 which surrounds the rearward portion 226 of the input shaft 208 and is mounted for free rotation thereabout by appropriate bearings 298. Attached to the hub 296, as by welding or the like shown at 300, is a generally circular main body portion 302 of the second output lever 294. The main body portion 302 is generally circular, surrounds the input shaft 208 and includes a rearwardly extending tang 304 (FIGS. 6, 6A and 13) which runs parallel to and on the outside of the tang 272 of the input lever 268. Both of the tangs 304 and 272 lie in the rotative path of the tang 244 of the outer spring arbor 236. The main body portion 302 of the second output lever 294 also includes an arcuate slot 306 having ends 306*a* and 306*b*; the slot 306 subtends an angle of approximately 180° similar to the slot 284. The tang 264 of the inner spring arbor 252 extends forwardly through the slot 306. Formed in the periphery of the main body portion 302 is a notch 308 which is approximately bisected by a radius of main body portion 302 drawn near the end 206*a* of the slot 306 and which subtends an angle of approximately 50°. The notch 308 includes ends 308*a* and 308*b* and is bisected by a diameter of the main body portion 302 which bisects the tang 304. It is to the main body portion 302 of the second output lever 294 that the first output lever 204 is mounted as more fully explained below. The outside of the hub 296 is journaled for rotation in a mounting plate 310 by bearings 312. The mounting plate 310 may be attached to the support plate 230 in any convenient manner (FIG. 5A).

Referring now to FIGS. 5A–13, the operation of the quick-break/quick-make mechanism 130 is described. The spiral spring 206 may be wound from either its inside or its outside to bias the hub 296 for rotation either clockwise or counterclockwise. Referring first to FIG. 5B, 6A and 8, the mechanism 130 is shown at a time when the spring 206 is discharged, that is, has no switch operating energy stored therein. When the spring 206 is thus discharged, the tangs 272 and 304 are aligned and are proximate to the tang 244, (they abut the spring and 246) and the slots 284 and 306 are aligned. The hub 296 has rotated in a clockwise direction as the spring 206 discharged. If it is desired to rotate the hub 296 in a counterclockwise direction, the following general sequence of operation is effected. The second output lever 294 is held in the position shown in FIGS. 5B, 6A and 8 and the input shaft 208 is rotated counterclockwise. Rotation of the input shaft 208 counterclockwise rotates the input lever 268 counterclockwise. Rotation of the input lever 268 rotates counterclockwise the main body portion 270 and the slot end 284*b*. The tang 264 of the inner spring arbor 252 is engaged by the slot end 284*b* and is similarly rotated counterclockwise. Rotation counterclockwise of the tang 264 of the inner spring arbor 252 rotates the inside end 266 of the spring 206 clockwise, which, as described above, stores energy in the spring 206 if the outside end 246 of the spring 206 is held. The holding of the second output lever 294 holds its tang 304 stationary. The stationary tang 304 prevents the tang 244 of the outer spring arbor 236 and the outside end 246 of the spring 206 from rotating. Thus, the outside end 246 of the spring 206 is held as the inside end 266 is rotated counterclockwise. As described earlier, this action stores energy in the spring 206. Following a predetermined amount of the rotation of the input shaft 208, the input lever 268 is now held. If the second output lever 294 is now released, it rotates counterclockwise to "follow" the previously rotated input lever 268. Counterclockwise rotation of the second input lever 294 rotates the first output lever 204 counterclockwise. If the output levers 204 and 294 are elements of the switch operating mechanism 48, the switches 40 of the left-hand assembly 32 are opened by this action. Similarly, if the output levers 204 and 294 are elements of the operating mechanism 50, the switches 40 of the right-hand assembly 34 are opened by this action. Following counterclockwise rotation of the output levers 204 and 294, the spring 206 is again discharged. If it is desired to reverse the condition of the switches 40, the following action takes place.

The tangs 272 and 304 are aligned, having previously rotated counterclockwise. The tang 272, it will be remembered, rotated counterclockwise first as the input lever 268 rotated counterclockwise to charge the spiral spring 206. This action occurred while the output lever 294 was held maintaining its tang 304 in a full clockwise position. Subsequently, the output lever 294 was released, causing it to "follow" the input lever 268 as the spring discharged. Furthermore, the slots 284 and 306 are also aligned. To recharge the spring 206 for clockwise rotation of the second output lever 294, the output lever 294 is held while the input lever 268 is rotated clockwise by clockwise rotation of the input shaft 208. Clockwise rotation of the input lever 268 has no effect on the tang 264 of the inner spring arbor 252, since the end 284*b* of the slot 284 is rotated away from such tang 264. However, clockwise rotation of the tang 272 of the input lever 268 causes such tang 272 to abut against the outside end 246 of the spring 206, moving that end 246 and the tang 244 of the outer spring arbor 236 clockwise. Since the output lever 294 is held in its full counterclockwise position, the end 306*b* of the slot 306 bears against the tang 264 of the inner spring arbor 252, thus preventing the inside end 266 of the spring 206 from rotating. Thus, this action causes the spring 206 to be wound up and to cause energy to be stored therein by holding the inside end 266 of the spring 206 and winding the outside end 246 thereof in a clockwise direction. Ultimately, the input lever 268 reaches its full clockwise position and it is held there until reclosure of the switches 40 is desired. When such closure is desired, the output lever 294 is released, causing it to "follow" the input lever 268 as the spring 206 discharges. Full clockwise rotation of the second output lever 294 causes the tang 304 to again align with the tang 272 and the slots 306 and 284 to align. Also, such clockwise rotation of the second output lever 294 moves the push-pull rods 202 downwardly to rotate the drive lever 200 either clockwise (operating mechanism 48) or counterclockwise (operating mechanism 50), thus closing the switches 40 of the compartments 24 and 26.

The action of the operating mechanism 50 for the switches 40 in the right-hand compartment 26 is the same as that described for the operating mechanism 48. "Mirror" image movement of the switches 40 of the right-hand compartment 26 is achieved by providing different relative connections among the push-pull rod 202, the first output lever 204, and the drive lever 200 in the operating mechanism 50. Thus, clockwise rotation of the output levers 204 and 294 of both mechanisms 48 and 50 closes the switches 40 in both compartments 24 and 26, while counterclockwise rotation of the output levers 294 and 204 of both operating mechanisms 48 and 50 opens the switches 40 in both compartments 24 and 26.

Quick-Break/Quick-Make Mechanism—Latches and Controls

Referring now to FIGS. 7–9, various latches and controls for the quick-bread/quick-make mechanism 130 of the operating mechanisms 48 and 50 are shown in detail. It should be remembered that only the operating mechanism 48 is depicted, the elements of the operating mechanism 50 being substantially similar.

The second output lever 294 is held in either its full clockwise or full counterclockwise position against rotation while the input lever 268 is rotated to charge the spring 206 by latch assemblies 320 and 322. The latch assembly 320 maintains the second output lever 294 in its full counterclockwise position as the input lever 268 is rotated clockwise, while the latch assembly 322 maintains the second output lever 294 in its full clockwise position while the input lever 268 is rotated counterclockwise.

Referring especially to FIG. 8, the latch assembly 320 comprises a lever 324 pivoted generally at its center on a pin 326, which is held between the mounting plate 310 and a mounting plate 328 fixed to the support plate 230. One end of the lever 324 mounts a roller 332 which is maintained in constant engagement with the periphery of the second output lever 294, including the notch 308 therein, by a spring 334 wound about the pin 326. The spring 334 acts between the lever 324 and the mounting plate 310 to constantly bias the lever 324 counterclockwise. Should the second output lever 294 be rotated sufficiently counterclockwise to bring the notch 308 thereof under the roller 332, such roller 332 enters the notch 308 due to the action of the spring 334 and engages the end 308*a* of the notch 308 preventing clockwise rotation of the second output lever 294 until the roller 332 is removed from the notch 308.

The latch assembly 322 includes a lever 336 rotatable generally about its center on a pin 338 fixed between the mounting plates 310 and 328. The lever 336 carries a roller 340 at one end thereof which is maintained in constant engagement with the periphery of the second output lever 294, including the notch 308 therein, by a spring 342 wound around the pin 338. The spring 332 acts between the lever 336 and the mounting plate 310 to constantly bias the lever 336 clockwise. Should the second output lever 294 be rotated sufficiently clockwise (as in FIG. 8) so that the notch 308 is positioned beneath the roller 340, such roller 340 enters the notch 308 and engages the end 308*b* of the notch 308 holding the second output lever 294 against counterclockwise rotation until such roller 340 is removed from the notch 308.

An armature 344 of a selectively energizable solenoid 346, which is mounted as appropriate to the support plate 230, is connected by a link 348 to the lever 324 near the roller 332. Energization of the solenoid 346 pulls the armature 344 thereinto, that is, leftwardly. Such movement of the armature 344 rotates the arm 324 clockwise against the action of the spring 344, moving the roller 332 away from the first output lever 294. An armature 350 of a solenoid 352 is connected to the lever 336 near the roller 340 by a link 354. Energization of the solenoid 352 pulls the armature 350 thereinto, that is, rightwardly, pulling the roller 340 away from the second output lever 294 by counterclockwise rotation of the lever 336. Thus, if energy has been stored in the spiral spring 206, either by operation of the hand crank 210 or of the motor 212, as described hereinafter, following entry of one of the rollers 332 or 340 into the notch 308 of the second output lever 294, energization of the appropriate solenoid 346 or 352 removes its roller 332 or 340 from such notch 308, permitting the second output lever 294 to "follow" the input lever 268, previous rotation of which stored energy in the spring 206.

The ends of the levers 324 and 336, opposite from the rollers 332 and 340, are connected by pins 356 and 358 to respective links 360 and 362. The links 360 and 362 contain elongated slots 364 and 366 through which the pins 356 and 358 extend and which permit a certain amount of lost motion movement between the links 360 and 362 and the levers 324 and 336. The ends of the links 360 and 362 remote from the slots 364 and 326 are commonly attached by a pin 368 to an arm 370 carried by, and keyed for movement with, a hexagonal shaft 372. The shaft 372 is carried by and journaled for rotation in the mounting plates 310 and 328 and in a shaft support 373 by appropriate bearings 374 (FIG. 7). The shaft support 373 is mounted to the mounting plate 310 by posts 375 (FIGS. 5A and 9).

If the roller 340 is within the notch 308 of the second output lever 294, as depicted in FIG. 8, and the shaft 372 is rotated clockwise, this clockwise rotation results in removal of the roller 340 from the notch 308, permitting the second output lever 294 to rotate counterclockwise assuming that the spring 206 has been previously charged. Specifically, clockwise rotation of the shaft 372 rotates the arm 370 clockwise. Clockwise rotation of the arm 370 moves the pin 368 clockwise, pulling the link 362 leftwardly. Leftward movement of the link 362 causes the right end of the slot 366 to engage the pin 358, rotating the lever 336 in a counterclockwise direction against the bias of the spring 342. Counterclockwise rotation of the lever 336, as described previously, removes the roller 340 from the notch 308 of the output lever 294. Such action, of course, also moves the link 354 rightwardly, pushing the armature 350 into the solenoid 352 without the energization thereof. Even through the lever 324 may be incapable of movement during this time—due both to the engagement of its roller 332 with the periphery of the second output lever 294 and the nearly full inward position of the armature 344 in the solenoid 346—clockwise rotation of the shaft 372 as just described may occur because clockwise rotation of the arm 370 and of the pin 368 causes the link 360 to move leftwardly as its slot 364 moves leftwardly relative to the pin 356. Similarly, if the roller 332 is within the notch 308 of the second output lever 294, counterclockwise rotation of the shaft 372 removes such roller 332 from the notch 308, permitting the second output lever 294 to "follow" the input lever 268, assuming the spiral spring 206 has been previously charged.

Because of the nature of the high-voltage circuit to which the switchgear 22 is intended to be connected, it is undesirable that either slow or partial operation of the switches 40 occur. As a consequence, it is desired that the spiral spring 206 be fully charged for operation of the switches 40 before the second output lever 294 can be released. Stated differently, if it were possible to release the second output lever 294 as the spiral spring 206 was being charged but before it was fully charged, either slow or partial operation of the switches 40 might occur. To prevent such slow or partial operation of the switches 40, there is provided a blocking arm assembly 376.

The blocking arm assembly 376 is a pair of spaced arms carried at their center by, and keyed for movement with, the shaft 372. The blocking arm assembly 376 includes a pair of pins 377 and 378 near the opposite ends of the arms thereof. A blocking shuttle 380 (FIGS. 7 and 8) cooperates with the blocking arm assembly 376 to prevent rotation of the shaft 372 unless the spring 206 has been fully charged and is capable of properly operating the switches 40. Referring to FIGS. 7, 8 and 12, the blocking shuttle 380 includes a cam follower 382 and a blocking link 384. The cam follower 382 comprises a finger-like member 386, a pointed end 388 of which rides against the surface of the cam member 282 carried by the input lever 268. Referring to FIG. 12, it may be seen that the cam member 282 is generally circular, but contains two peripheral depressions 390 and 392. The depressions 390 and 392 are oriented with respect to the input lever 268 so that the pointed end 388 of the cam follower 382 is positioned therewithin only when the input lever 268 has been fully rotated—clockwise or counterclockwise—to fully charge the spring 206. Thus, if the pointed end 388 of the cam follower 382 is within one of the depressions 390 or 392, the cam follower 382 assumes a lower-most position (FIGS. 7 and 8). Again, this lower-most position is achieved only when the input lever 286 is in its full clockwise or counterclockwise position. In any other position of the input lever 268 as it moves either clockwise or counterclockwise to charge the spring 206, the pointed end 388 of the cam follower 382 is moved to an upper-most position by a portion 394 of the cam 382 between the depressions 390 and 392.

The blocking link 384 of the blocking shuttle 380 comprises an elongated member 396 which may be formed integrally with the member 386 or may be attached thereto, such as by the rivets 398 depicted. The member 396 contains at its lower end an elongated slot 400 which surrounds the bushing 273 of the input lever 268. The slot 400 may slide over the bushing 273 between the cam 282 and a spacer 401 so that the blocking shuttle 380 is freely moveable up and down as the cam follower 382 is reciprocated by the cam 282. The upper portion of the member 396 includes an elongated slot 402 which surrounds the shaft 372 between the arms of the blocking arm assembly 376 and permits the blocking shuttle 380 to move freely up and down. This support of the member 396 by means of its slots 400 and 402 maintains the blocking shuttle 380 in a generally vertical orientation. The upper end of the member 396 is so formed as to include a pair of ledges 404 and 406 (FIGS. 6A and 8). When the pointed end 388 of the cam follower 382 is within one of the depressions 390 or 392 formed in the cam 282, the blocking shuttle 380 assumes its lower-most position and the ledges 404 and 406 are maintained sufficiently beneath the pins 377 and 378 of the blocking arm assembly 376 to permit free rotation of the arm 376 and, thus, free rotation of the shaft 372. However, should the input lever 268 be rotated in either direction to charge the spring 206, the pointed end 388 of the cam follower 282 is moved to its upper-most position by the cam portion 394. Such upward movement of the blocking shuttle 380 moves the ledges 404 and 406 into proximity, if not into abutment with, the pins 377 and 378. The proximity of the ledges 404 and 406 to the pins 377 and 378 prevents the blocking arm assembly 376 from rotating which, accordingly, prevents the shaft 372 from rotating. Thus, while the input lever 268 is being rotated to charge the spring 206, the shaft 372 cannot be rotated. This prevents possible improper operation of the switches 40 due to untimely rotation of the shaft 372.

Just as the second output lever 294 must be held by the latch assemblies 320 and 322 during rotation of the input lever 268 to properly charge the spring 206, so too, the input lever 268 must be held or latched following its rotation to a position which charges the spring 206. To this end, there are provided input lever latch assemblies 408 and 410.

Referring to FIGS. 6A and 8, the input lever latch assembly 408 includes the lever 412 pivotally carried by the pin 326. The lever 412 includes at its right end a latchblock 414, which is kept in constant engagement with the periphery of the input lever 268, including the notch 388, by springs 416 and 418. The spring 416 is wound about the pin 326 and acts between the lever 412 and the mounting plate 328. The spring 418 is connected between a spacer post 420 between the mounting plates 310 and 328 and the lever 412. Both springs 416 and 418 bias the lever 412 in a clockwise direction so that the latchblock 414 constantly engages the periphery of the input lever 268, as described above. The input lever latch assembly 410 includes a lever 422 pivotally mounted on the pin 388. The left end of the lever 422 carries a latchblock 424 which is held in constant engagement with the periphery of the input lever 268, including the notch 286 formed therein, by a pair of springs 426 and 428. The spring 426 is wound about the pin 388 and is connected between the lever 422 and the mounting plate 328, while the spring 428 is connected between a spacer post 430 between the mounting plates 310 and 328. Both springs 426 and 428 tend to bias the lever 422 in a counterclockwise direction so that the above-described constant engagement between the latchblock 424 and the periphery of the input lever 268 is maintained.

The second output lever 294 carries a pair of kickers 432 and 434. The kickers 432 and 434 so positioned and located as to remove a respective latchblock 414 or 424 from its respective notch 288 or 286 in the input lever 268 following complete rotation of the second output lever 294. This removal of the latchblocks 414 and 424 from their notches 288 and 286 permits rotation of the input lever 268 following discharge of the spring 206 by rotation of the second output lever 294.

A partial cycle of operation of the apparatus depicted in FIG. 8 will now be described with additional reference to FIGS. 6 and 6A. In FIG. 8, the spring 206 is discharged and the tangs 304 and 272 of the second output lever 294 and the input lever 268, respectively, are aligned (in abutment with the end 246 of the spring 206 and the tang 244 of the outer spring arbor 236) as are the slots 284 and 306. The switches 40 of the switch assembly 32 are closed. In order to charge the spring 206 for a subsequent opening of the switch assembly 32, the input shaft 208 must be rotated counterclockwise either manually, as described below, or by the motor 212, in a manner to be described below. Assuming that the input shaft 208 rotates counterclockwise, the input lever 286 rotates counterclockwise. Counterclockwise rotation of the input lever 268 moves the end 284*b* of its slot 284 against the tang 264 of the inner spring arbor 252. The tang 264 rotates counterclockwise away from the end 306*b* of the slot 306 in the second output lever 294. Simultaneously therewith, due to the action of the spring 342, the roller 340 engages the end 308*b* of the slot 308 in the second output lever 294; this prevents the second output lever 294, the outer spring arbor 236 and the outside end 246 of the spring 206 from rotating. Thus, continued counterclockwise rotation of the input lever 268 winds up the spring 206 to store energy therein and such action continues until the latchblock 424 enters the notch 286 in the input lever 268 due to the action of the springs 426 and 428. Assuming that the input shaft 208 now ceases rotating, the input lever 268 is held in its full counterclockwise position by the latchblock 424 and the second output lever 294 is held in its full clockwise position by the roller 340. During the time that the spring 206 was being charged, the shaft 372 was rendered unrotatable, as described previously, by the blocking shuttle 380. Once the input lever 268 reaches the position where the latchblock 424 enters the notch 286, however, the shaft 372 can again be rotated. Accordingly, the spring 206 may now be discharged either by clockwise rotation of the shaft 372 or by energization of the solenoid 352, either of which removes the roller 340 from the notch 308. Removal of the roller 340 from the notch 308 permits the second output lever 294 to "follow" the input lever 268, that is, to rotate in a counterclockwise direction. This rotation of the second output lever 294 discharges the spring 206 and, as described generally above, moves the push-pull rods 202 upwardly to open the switches 40. As the second output lever 294 completes its counterclockwise rotation, the kicker 434 removes the latch block 424 from the notch 286 so that the input lever 268 may be subsequently rotated in a clockwise direction to recharge the spring 206. Also, upon complete counterclockwise rotation of the second output lever 294, the roller 332 enters the notch 308 under the action of the spring 334. Such roller 332 will thus hold the second output lever 294 during a subsequent restoration of energy to the spiral spring 206.

If the spring 206 is now recharged, the input shaft 208 is rotated in a clockwise direction. The second output lever 294 cannot rotate because the roller 332 has entered the notch 308. Accordingly, the tang 264 of the inner spring arbor 252 and the inside spring end 266 cannot rotate, as the tang 264 abuts the end 306*b* of the slot 306 in the held second output lever 294. The input lever 268 is free to rotate clockwise because the kicker 434 has removed the latch block 424 from the notch 286. As the input lever 268 rotates clockwise, its tang 272 bears against the outside spring end 246 and the tang 244 of the outer spring arbor 236, rotating both in a clockwise direction to again wind up the spiral spring 206. This rotation of the input lever 268 continues until the latch block 414 enters the notch 288, at which point the input lever 268 is held if the input shaft 208 ceases rotation. Following this recharging of this spring 206, the roller 332 may be removed from the notch 308 either by counterclockwise rotation of the shaft 372 or energization of the solenoid 346 to permit the second output lever 294 to rotate clockwise. Should this occur, all of the elements again assume the position shown in FIG. 8. During clockwise rotation of the second output lever 294, the switches 40 are closed due to downward reciprocation of the push-pull rods 202.

Motor cut-off switches 436 and 438 are respectively mounted to the support plates 230. The left-hand motor cutoff switch 436 is a conventional microswitch containing an exterior operating member 440. The operating member 440 is positioned and oriented so as to be abutted by a cam-like member 442 attached to, or formed integrally with, the lever 412 of the input lever latch assembly 408. The engagement between the cam-like member 442 and the operating member 440 can occur only when the latch block 414 has fully entered the notch 288 in the input lever 268. In any other position of the latch block 414, the cam-like member 442 does not contact the operating member 440. The contacts (FIG. 22) of the microswitch 436 are normally closed and they are opened by contact between the cam-like member 442 and the operating member 440. The motor cutoff switch 438 similarly has an operating member 444 positioned and oriented so as to be contacted by a cam-like member 446 on the end of the lever 422 opposite from the latch block 424. If, and only if, the latch block 424 enters the notch 286 in the input lever 268, do the normally closed contacts of the switch 438 open. As described more fully below with respect to the control circuit schematic of FIG. 22, the opening of either switch 436 or 438 opens the energizing circuit of the motor 212, causing such motor 212 to cease rotating the input shaft 208. As should be clear, when either switch 436 or 438 has its normally closed contacts opened, one of the latch blocks 414 or 424 has entered one of the notches 288 or 286 of the input lever 268 indicating that such input lever 268 has rotated fully, either clockwise or counterclockwise to fully charge the spring 206.

Also, as described more completely below with reference to FIG. 22, the energizing circuit of the motor 212 also includes a pair of latch responsive switches 448 and 450, respectively (FIGS. 5B and 9). The switches 448 and 450 are standard microswitches and each contain a pair of normally open and a pair of normally closed contacts for a purpose to be described subsequently. Switch operating levers 452 and 454 are pivotally mounted near their center by pins 456 and 458 affixed to extensions 459 of the mounting plate 310. The levers 452 and 454 are also pivotally mounted by pins 460 and 462 to the armature 344 and 350 which may be the same pins mounting the links 348 and 354 thereto, of the respective solenoids 346 and 352, respectively. Springs 464 and 466 acting between the pins 360 and 362, respectively, and the mounting plate extensions 459 bias the lever 452 clockwise and the lever 454 counterclockwise. The ends of the levers 452 and 454 opposite the pins 360 and 362 are formed to have cam-like contours 468 and 470. As best shown in FIG. 9, if one of the armatures 344 or 350, for example, the armature 344, is pulled fully into its solenoid 346 or if the respective roller 332 is out of the notch 308 for any reason, the respective lever 452 or 454, here the lever 452, is rotated against the bias of its respective spring 464, maintaining the cam end 468 of the lever 452 out of engagement with an operating member 472 for the switch contacts 448, thus leaving the switch (not shown; see FIG. 22) in their normal condition. If, however, one of the armatures 344 or 350, such as the armature 350, is pulled out of its respective solenoid 352 or if the roller 340 is in the notch 308, the lever 454 is rotated in the direction of the bias of the spring 466 to position the cam end 470 in contact with a switch operating member 474 for the switch 450. This reverses the condition of the contacts (see FIG. 22) of the switch 450. Conversely, if the roller 332 is in the notch 308, the contacts of the switch 448 have their condition reversed. Similarly, if the roller 340 is not in the notch 308, its contacts remain in their normal condition.

Figure 18A:
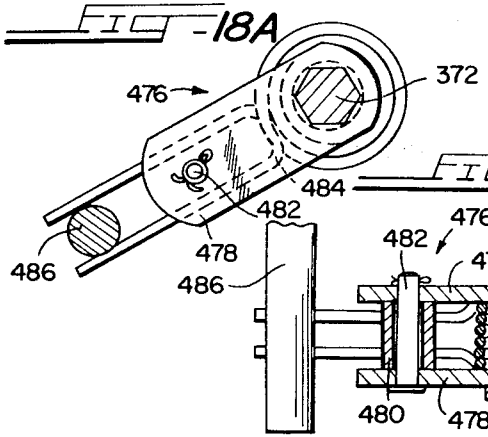
FIGS. 18A and 18B are, respectively, a front, partially sectioned view and a top partially sectioned view of a portion of the operating mechanism of FIG. 7 taken along line 18A—18A therein.
Figure 18B:
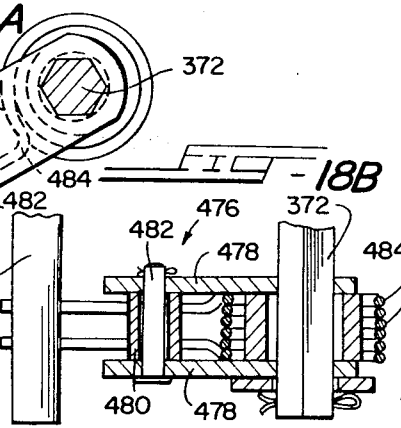

Returning for a moment to the shaft 372, such shaft 372 and the connected arm 370 have a normal position, as shown in FIGS. 5B, 8 and 9 and are always returned to this position after clockwise or counterclockwise rotation of the shaft 372 by a spring biasing mechanism 476. Referring to FIGS. 7 and 18, the spring biasing mechanism 476 comprises a pair of arms 478 mounted by, and keyed to one end of, the shaft 372. The arms 478 are maintained apart by means of a spacer 480 through which and through the opposite ends of the arms 478 passes a pin 482. One or more springs 484 is loosely wound around the shaft 372 and opposed ends of the spring 484 pass on opposite sides of the pin 482 and are position on opposite sides of a stationary pin 486 fixed to the mounting plate 382. As can be seen, if the shaft 272 is rotated out of its normal position in either direction, one spring end remains abutted against the stationary pin 486, while the other spring end is carried away therefrom by the pin 482. The movement apart of the spring ends stores energy in the spring 484 which tends to bias the shaft 372 back to its normal position.

Charging the Spring

As noted earlier, the spring 206 may be charged either by the motor 212 or by the use of the hand crank 210.

There will first be described charging of the spring 206 by the motor 212. As noted earlier, the second sprocket 216 is rotated by the first sprocket 214 via the chain 218. The motor 212 is rotatable clockwise and counterclockwise (see FIG. 22) and, thus, the second sprocket 216 may rotate in either direction. Referring to FIG. 7, the second sprocket 216 is welded or otherwise attached to an input hub 500. The input hub 500 is freely rotatable on a bushing 502, fixed to the input shaft 208, via bearings 504. The right end of the hub 500 carries a clutch plate 508 having a hexagonal hole 510 formed therethrough. The hexagonal hole 510 is engageable by the hexagonal periphery 512 of a clutch member 514. The clutch member 514 has a hexagonal hole 516 formed therethrough for engagement with the hexagonal periphery of the input shaft 208. The clutch member 514 may be slid longitudinally along the input shaft 208. A spring 518, positioned with a chamber 520 defined by the input hub 500, the bushing 502 and the input shaft 208, acts between the bushing 502 and the clutch member 514 to normally position such member 514 so that its hexagonal periphery 512 engages the hexagonal hole 510 in the clutch plate 508 and its hexagonal hole 516 engages the hexagonal input shaft 208. A retainer plate 522 mounted to the hub 500 prevents the clutch member 514 from coming off the end of the input shaft 208.

Thus, in its normal position, the clutch member 514, under the action of the spring 518, receives torque applied to the second sprocket 216 by the chain 218 to rotate the input shaft 208. Torque applied to the second sprocket 216 is applied therefrom to the input hub 500 and from there to the clutch plate 508 and the clutch member 514, both of which apply such torque to the input shaft 208.

The hand crank 210 includes a hexagonal socket 524 formed in a body portion 526. If it is desired to rotate the input shaft 208 and charge the spring 206 with the hand crank 210, the body portion is inserted through the hole 211 formed through the side walls 122 and 124 of the compartments 51 and 52 and through a central hole 528 in the retainer plate 522, and is pushed into the chamber 520. Such movement of the body 526 of the hand crank 210 causes it to abut the clutch member 514, moving it back against the action of the spring 518 until its hexagonal periphery 512 is moved out of engagement with the hexagonal hole 510 in the clutch plate 508. Ultimately, the hexagonal socket 524 in the body 526 engages the hexagonal forward portion 224 of the input shaft 208. Following this, the hand crank 208 may be rotated in either direction to charge the spiral spring 206. Note, that while the shaft 208 is being rotated by the hand crank 210, the motor 212 cannot rotate the shaft 208 because of the disengagement between the clutch member 514 and the clutch plate 508.

Thus, in the description thus far, there has been described high-voltage switchgear 20, the switches 40 of each assembly 32 and 34 of which can be operated by energy stored in the springs 206 of the respective operating mechanisms 48 and 50. Energy may be stored in each spring 206 either manually or through its operation of the motor 212. Further, once stored, such energy may be released to operate the switches 40 either electrically via the solenoids 346 and 352 or manually via rotation of the shaft 372.

Drive Train

As noted previously, rotation of the second output lever 294 rotates the first output lever 204. It is to the first output lever 204 that the push-pull rod 202 is connected. The second output lever 294 includes the hub 296, as previously described. Referring to FIGS. 7 and 19, the forward end of the hub 296 may be externally splined, as at 546. The splines 546 are designed to mate with matching splines 548 formed in the walls of a hole 549 through the first output lever 204. The output lever 204 is mounted to the hub 296 by appropriately mating the splines 548 with the splines 546 and then fastening the levers 204 and 294 together with screws 550 or the like. As noted earlier, although the operating mechanisms 48 and 50 are similar, the normal orientation of the first output levers 204 thereof with respect to the second output levers 294 thereof are slightly different. The splines 546 and 548 permit the first output lever 204 of each operating mechanism 48 and 50 to be appropriately angularly adjusted with respect to its respective second output lever, as described more fully below.

The second output lever 204 contains a hole 551 formed therethrough near its lower end. An upper linkage clevis 552 is pivotably attached to the first output lever 204 by a headed pin 554, which passes through both the clevis 552 and the hole 551. The pin 554 may be held in place by an appropriate cotter key or the like. The clevis 552 is attached to the push-pull rod 202 by mating an upper threaded portion of the push-pull rod 202 and threads formed interiorly of an axial hole in the clevis 552. The relative orientation of the push-pull rod 202 and the clevis 552 may be maintained by a nut 556, or the like, threaded onto the upper portion of the push-pull rod 202. A lower threaded portion of the push-pull rod 202 is threaded into an interiorly threaded hole of a lower linkage clevis 558. Again, the push-pull rod 202 and the clevis 558 may be held in a desired orientation by an appropriate nut or other fastener 560. The lower linkage clevis 558 is pivotably attached to the drive lever 200 by means of a headed pin 562 (FIG. 15) passing through the lower linkage clevis 558 and the drive lever 200. Again, the pin 562 may be held in place by a cotter key or the like. As best shown in FIG. 5B and the lower linkage clevis 558 of the operating mechanism 48 is attached to the right side of the drive lever 200, while the lower linkage clevis 558 of the operating mechanism 50 is attached to the left side of its drive lever 200; the drive levers 200 are mirror images of each other. Further, in the full counterclockwise position of each hub 296, the first output lever 204 of the operating mechanism 48 is attached to its hub 296 in a more counterclockwise orientation than is the first output lever 204 of the mechanism 50. This attachment of the lower linkage clevises 558 to their drive levers 200, as well as the relative positions of the respective first output levers 204 with respect to their hubs 296, are so related that the above-described operation of the switches 40 in each compartment 24 and 26 is achieved. Specifically, as noted earlier, the switches 40 of both compartments 24 and 26 are closed by the clockwise rotation of the output levers 204 and 294 and are opened by counterclockwise rotation of these output levers 204 and 294. However, closure of the switches 40 in the left-hand compartment 24 is achieved by clockwise rotation of the drive layer 200, whereas closure of the switches 40 in the right-hand compartment 26 is achieved by counterclockwise rotation of the drive lever 200. Similarly, opening of the switches 40 of the left-hand compartment 24 is achieved by counterclockwise rotation of the drive lever 200, whereas opening of the switches 40 in the right-hand compartment 26 is achieved by clockwise rotation of the drive lever 200. It should be obvious to those skilled in the art that other arrangements which do not depart from the general arrangement herein described can easily be achieved.

Figure 14A:
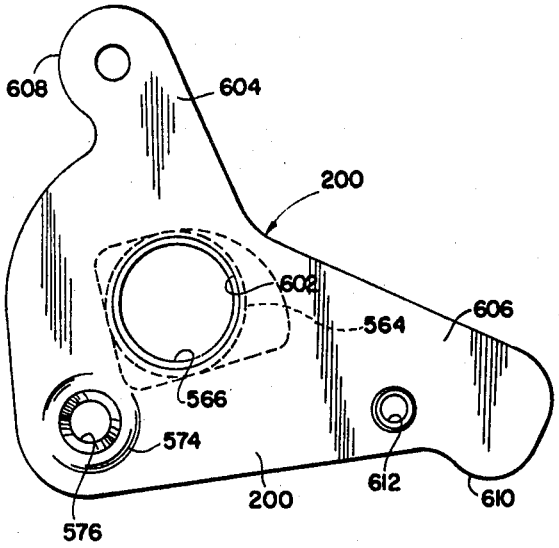
FIGS. 14A and 14B are, respectively, a front elevation and a side, partially sectioned elevation of an output lever for the operating mechanism of FIGS. 5A and 5B.
Figure 14B:
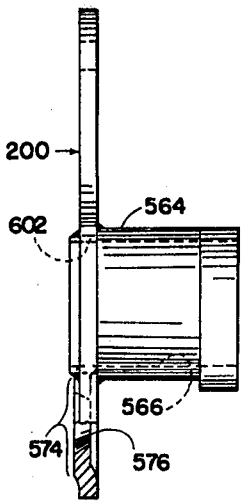
Figure 15:
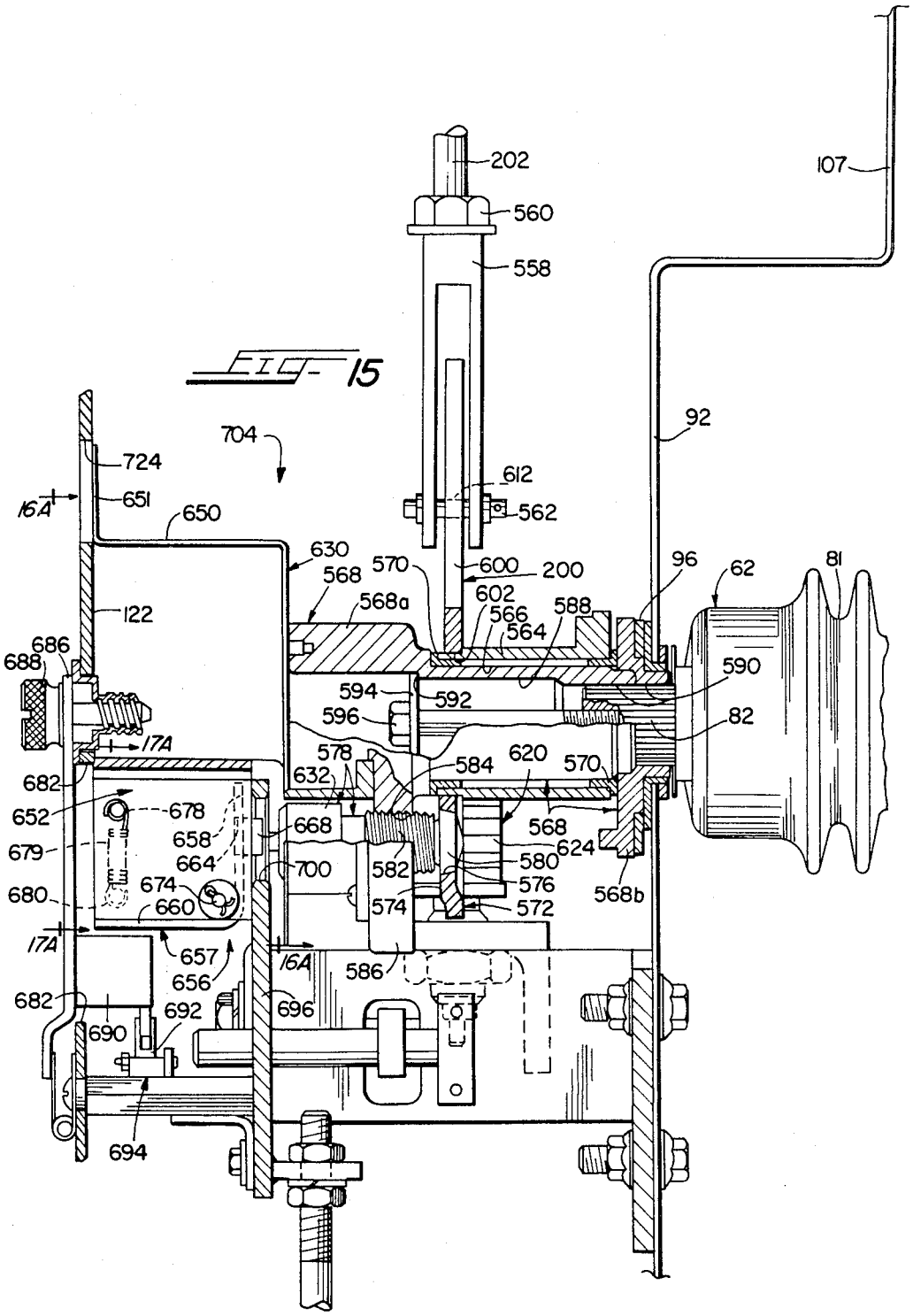
FIG. 15 is a side, elevational, partially sectioned view of a decoupling mechanism for the switchgear of the present invention taken generally along line 15—15 in FIG. 5B.

Referring to FIGS. 14–17, the drive lever 200 is attached by welding or the like to a hollow stub shaft 564 having a passageway 566 therethrough. The passageway 566 surrounds the exterior of an elongated strut-driving shaft 568 which may comprise two parts **568*a* and 568*b* attached together as by pressing or the like. Appropriate bearings 570 between the stub shaft 564 and the outside of the strut-driving shaft 568 permit the stub shaft 564 and the strut-driving shaft 568 to freely rotate independently of each other. A lower-most portion 572 of the drive lever 200 has a dimple 574 formed therein as by pressing or the like (FIGS. 14 and 15). Formed centrally through the dimple is a conically tapered hole 576. A coupling bolt 578 (FIG. 16), having a tapered and rounded conical head 580 contains a threaded portion 582 held in a threaded hole 584 formed through a downwardly depending arm 586 on the strut driving shaft 568. The coupling bolt 578 may be screwed into the hole 584 so that the conical head 580 is firmly maintained within the hole 576 of the drive lever 200. The strut-driving shaft 568 contains an interior chamber 588, one end of which is splined as at 590. The splines 590 mate with the right and left splined studs 82 on the insulative struts 62 of the left and right switch assemblies 32 and 34, respectively. The bearing assemblies 96 (FIGS. 4A, 4B, and 15) support the stud-driving shaft part 568*b* for rotation in the lower side walls 92 and 94 of the compartments 51 and 52. To ensure that the splined studs 82 do not pull free from the splines 590, or vice versa, the chamber 588 defines a shoulder 592 against which a washer 594 is pulled when a headed bolt 596 is threaded into an appropriate threaded hole in the splined stud 82**.

When the coupling bolt 578 is in its normal position depicted in FIG. 15, the drive lever 200 is coupled to the strut-driving shaft 568 so that the lever 200, the stud shaft 564, and the strut-driving shaft 568 rotate conjointly. Such conjoint rotation effects rotation of the splined stud 82 of the insulative strut 62 causing rotation of the switch blades 60 of the switches 40, as previously described. If, however, as described below, the coupling bolt 578 is rotated so that its head 580 is backed out of the hole 576 in the drive lever 200, rotation of the drive lever 200 merely rotates the stub shaft 564, but does not rotate the strut-driving shaft 568 nor the insulative strut 62. The purpose of the coupling bolt 578 is to selectively permit the operating mechanisms 48 and 50 to be "exercised" for test, maintenance adjustment, or the like, purposes without affecting the condition of the switches 40 normally operated by such operating mechanisms 48 and 50.

Referring to FIGS. 5B and 14, each drive lever 200 comprises a plate-like member 600 containing a generally central hole 602 for receiving the stub shaft 564. On either side of the hole 602 are a pair of assymetric arms 604 and 606 which contain lobes 608 and 610 thereon. One arm 606 contains a hole 612 therethrough for receipt therein of the pin 562 which connects the lower linkage clevis 558 to the drive lever 200. The conically tapered hole 576 which receives the conical head 580 of the coupling bolt 578 is generally located on a diameter of the hole 602 which bisects the arms 604 and 606. Surrounding the hole 576 is the dimple 574. The drive lever 200 of FIG. 14 is used in the operating mechanism 48. The drive lever 200 of the mechanism 50 is the mirror image of the one depicted in FIG. 14, as shown in FIG. 5B.

Each operating mechanism 48 and 50 includes a pair of shock absorbers 620 and 622. The shock absorber 620 intercepts the rotative path of the lobe 608 as the drive lever 200 rotates while the shock absorber 622 intercepts the rotative path of the lobe 610. The shock absorbers 620 and 622 may generally comprise a stack of resilient members 624 which receive the impact of the lobes 608 and 610 as the drive lever 200 rapidly rotates to rotate the insulative strut 62. The shock absorbers have the capability of receiving kinetic energy from the rapidly moving drive levers 200 and dissipating that energy so that other elements of the operating mechanisms 48 and 50 are not violently jarred or vibrated to the detriment thereof. The quick-break/quick-make mechanisms 130 may also include shock-absorbing bumpers or stops 625 and 626, as shown in FIG. 9. The bumpers 625 and 626 are mounted to the back side of the mounting plate 310 and may include resilient members, shown generally at 627 in FIG. 9, which intercept the rotative path of the tang 304 of the second output lever 294 to the same end as the shock absorbers 620 and 622.

The relative position and orientation among the lobes 608 and 610, the holes 576, 602 and 612, and the shock absorbers 620 and 622 is such that, as best shown in FIG. 5B, when the switches 40 are in the closed position, the push-pull rod 202 forms an over-center toggle with respect to the centers of rotation of the output lever 204 and the drive lever 200. As can be seen by observing the operating mechanism 48 in FIG. 5B, the major axis 528 of the push-pull rod 202 between the hole 612 (whereat the lower clevis 558 is connected) and the hole 551 (whereat the upper clevis 552 is connected) lies slightly to the left of an imaginary line 529 drawn between the center of rotation of the first drive lever 204 and the hole 612. Since the levers 200 and 204 can rotate no further in the counterclockwise direction (due to the shock absorbers 622 and the bumpers 625), this relationship between the axis 628 and the line 629 is an over-center toggle, whereby the switch blades 60 of the switches 40 in the left-hand compartment 24 are locked in their closed position. The switches 40 in the right-hand compartment 26 are similarly locked in the closed position.

Decoupling Feature-FIGS. 1, 15 and 16

Attached to the end of the strut-driving shaft 568 remote from the splines 590 is an indicator plate 630, as explained more fully later. The indicator plate 630 rotates with the strut-driving shaft 568.

Figure 16A:
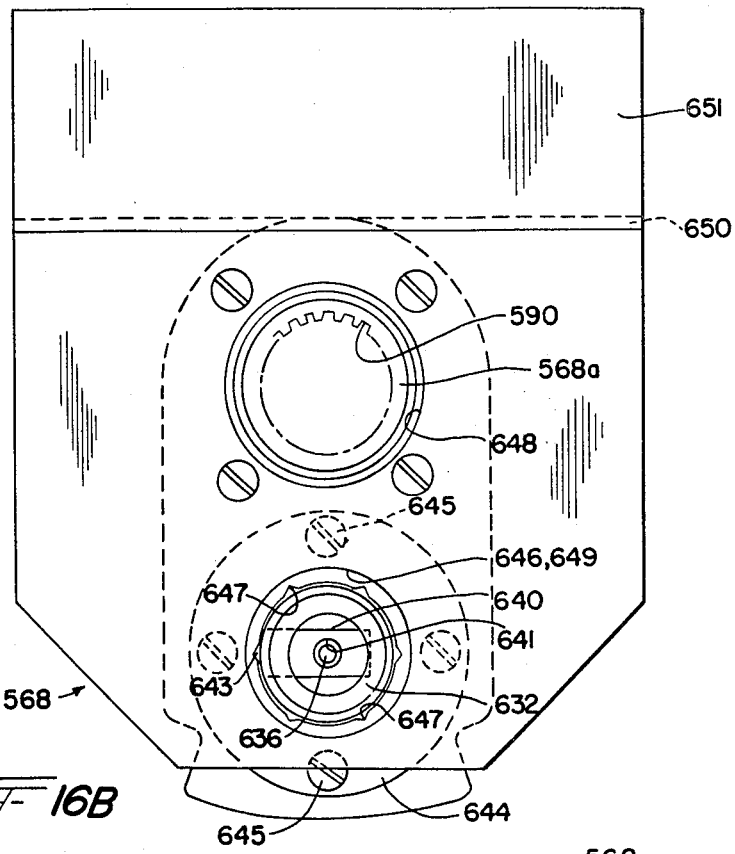
FIGS. 16A and 16B are, respectively, a front elevation and side, partially sectioned elevation of a portion of a decoupling bolt assembly for the decoupling mechanism of FIG. 15, the former being taken generally along line 16A—16A in FIG. 15.
Figure 16B:
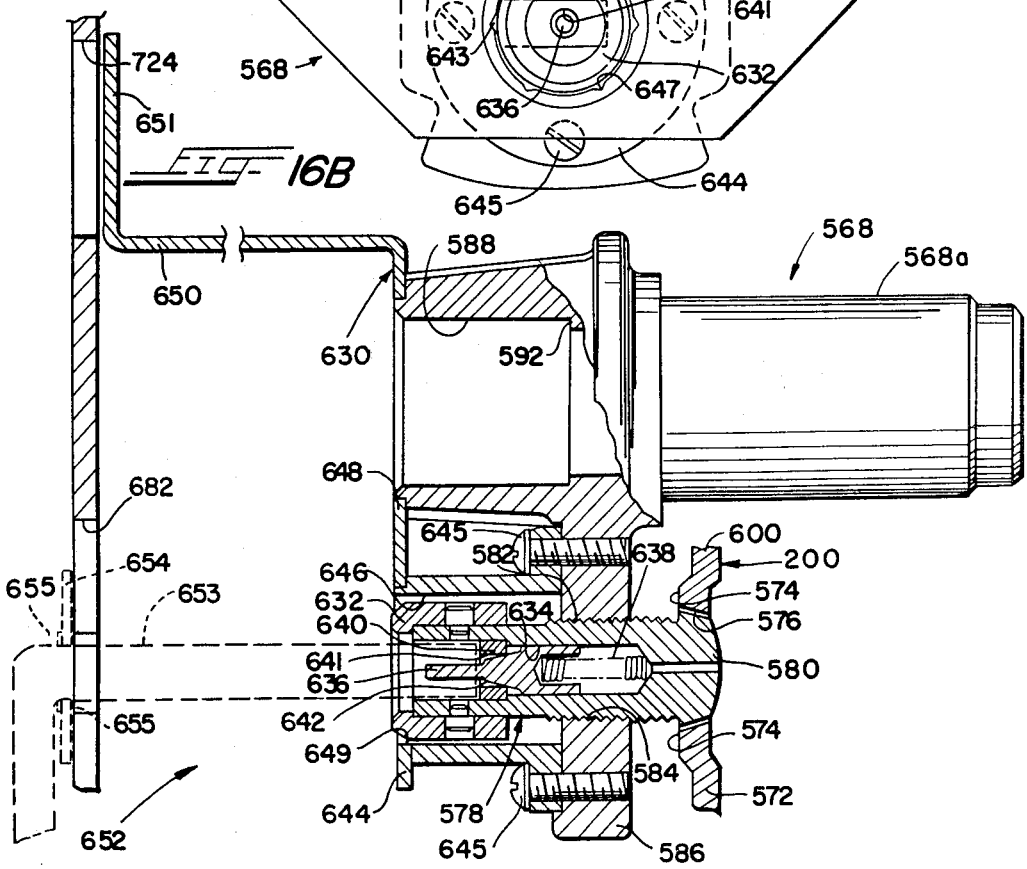

As noted previously, the coupling bolt 578 is rotatable into and out of the hole 576 formed through the dimple 574 at the lower-most portion 572 of the drive lever 200. Referring to FIG. 16, the end of the coupling bolt 578 remote from the conical head 580 carries a cap 632 which surrounds the coupling bolt 578 and is attached thereto in any convenient fashion. The cap 632 surrounds a portion of the coupling bolt 578 which contains the open end of a blind bore 634 having a rectangular cross-section. The blind bore 634 contains a plunger 636 which is freely slidable within the bore 634. A spring 638 biases the plunger 636 outwardly against a pin 640 transversely slidable in the bore 634. The pin 640 includes a central aperture 641, engageable by a tapered cam surface 642 of the plunger 636 and a pointed end 643. The pointed end 643 protrudes outside of the coupling bolt 578 and the cap 632. A lock stud 644 attached by screws 645 or the like to the arm 586 of the strut-driving shaft 568 has a passageway 646 surrounding the coupling bolt 578 and the cap 632. The periphery of the passageway 646 is generally hexagonal or has six hexagonally spaced depressions 647 therein. The spring 638 causes the cam surface 642 on the plunger 636 to bias the pointed end 643 of the pin 640 outwardly against the periphery of the passageway 646. Thus, unless the plunger 636 is moved back and held in the bore 634 against the spring 638, the coupling bolt 578 can, at most, freely turn 60° or the angle between the depressions 647, before the pointed end 643 enters one of the depressions 647, locking the coupling bolt 578 further rotation. Accordingly, the locking bolt 578 can be freely rotated into or out of the passageway 646 only if a square or rectangular cross-section tool is inserted into the rectangular cross-section blind bore 634 sufficiently far to engage the walls thereof and to hold the plunger 636 in so that the pin 640 is not pushed into the depressions 647 (see FIG. 16B).

The indicator plate 630 contains two holes 648 and 649, the former of which gives access to the chamber 588 (for insertion of the headed bolt 596, for example) and the latter of which gives access to the blind bore 634 of the coupling bolt 578 (for rotating the coupling bolt 578). The indicator plate 630 contains a portion 650 extending longitudinally away from the strut-driving shaft 568 and an upstanding portion 651 generally parallel to, but forward of, the main portion of the strut-driving shaft 568.

Referring to FIGS. 1 and 15 and 16, a compartment 652 is defined between the indicator plate 630 and the exterior wall 122 or 124 of the compartments 51 or 52. The decoupling bolt 578 is accessible through this compartment 652, as explained below. Such access permits a square cross-section Allen-wrench-type tool 653 to be inserted into the blind bore 634 for depressing the plunger 636 and rotating the coupling bolt 578. The tool 653 may mount a collar 654 freely rotatable thereon and held in position by spaced pins 655. The user of the tool 653 may hold the tool 653 between the fingers of one hand, while the tool 653 is rotated with the other hand to rotate the coupling bolt 578.

Figure 17A:
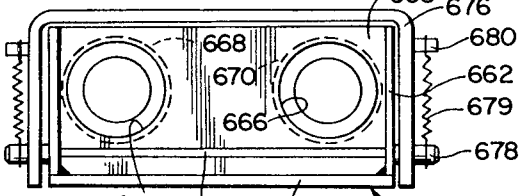
FIG. 17A and 17B, respectively, a front elevation and a side, partially sectioned view of a shutter for the decoupling mechanism of FIG. 15, the former being taken along line 17A—17A therein.
Figure 17B:
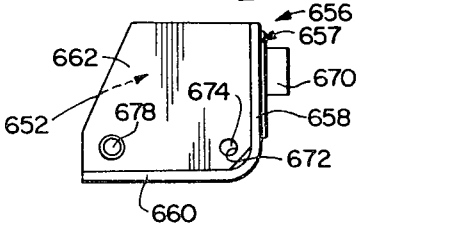

The coupling bolt 578 is movable toward or away from the drive lever 200 by rotation of the tool 653, as described above. If the tool is rotated counterclockwise, as viewed in FIGS. 1, 5B or 16A, the coupling bolt 578 is moved away from the drive lever 200 as it and the cap 632 move out of the passageway 646 of the lock stud 644 and the conical head 580 withdraws from the tapered hole 576. As the coupling bolt 578 moves away from the drive lever 200, it moves toward a shutter 656 located in the compartment 652 (FIGS. 15–17).

The shutter 656 comprises a metallic member 657 bent centrally at a 90° angle to define a back plate 658 and a bottom plate 660. The back plate 658 fronts the arm 586 of the strut-driving shaft 568 and the bottom plate 660 extends outwardly away therefrom. Side plates 662 are connected to either end of the bottom plate 660. The back plate 658 has a pair of holes 664 and 666 formed therethrough. The holes 664 and 666 may be surrounded by guide bushings 668 and 670 which are mounted to the back of the back plate 658 and which are formed to at least partially encircle the holes 664 and 666. The side plates 662 contain aligned holes 672 through which passes a shaft 674 which is mounted between a U-shaped structural member 676 mounted to the wall 122 or 124 in the compartment 652. The side plates 662 mount studs 678, and tension spring 679 are connected between the studs 678 and studs 680 on the structural member 676 to maintain the shutter 656 in the normal position depicted in FIGS. 15 and 17. The shutter 656 may be rotated on the shaft 674, moving the bottom plate 660 downwardly and the back plate 658 forwardly. The holes 664 and 666 are sufficiently large for insertion of the tool 653 therethrough. Moreover, the holes 664 and 666 are located so that one of the holes 664 or 666 aligns with the blind bore 634 in the coupling bolt 578 when the drive lever 200 is in one of its extreme positions, as determined by the shock absorbers 620 or 622. The diameter of the guide housings 668 and 670 is such that sufficient withdrawal of the coupling bolt 578 by the tool 653 causes the cap 632 to engage the bushings 668 or 670. As shown in FIG. 5, such engagement between the cap 632 and the bushings 668 or 670 occurs well before the conical head 580 of the coupling bolt 578 is a fully withdrawn from the hole 576 in the drive lever 200.

Following initial engagement between the cap 632 and the bushings 668 or 670 as the coupling bolt 578 is rotated counterclockwise by the tool 653, continued withdrawal of the coupling bolt 578 moves the bushings 668 or 670 to rotate the shutter 656 so that the bottom plate 660 rotates downwardly and the back plate 658 rotates fowardly. When one hole 664 or 666 is aligned with the blind core 634 of the coupling bolt 578, the other hole 666 or 664 is covered from behind by the indicator pulse 630.

Whichever hole 664 or 666 is aligned with the blind bore 634 in the coupling bolt 578, such hole 664 or 666 is reached via the compartment 652 which is bounded by the shutter 656 and the U-shaped member 676. The compartment 652 is entered through an opening 682 formed through the exterior side walls 122 and 124 for the operating mechanisms 48 and 50. The opening 682 is normally closed by a cover 686 which is hinged to the walls 122 and 124 in any convenient manner to uncover the opening 682 and expose the compartment 652. The cover 686 may be normally held in its closed position by a fastener 688 which selectively engages the wall 122 or 124. The cover 686 mounts a projecting tab 690 which, when the cover 686 closes the opening 682, extends into the compartment 652 beneath the bottom plate 660 and holds down the operating member 692 of a standard microswitch 694 beneath the compartment 652. Opening of the cover 686 moves the tab 690 out of engagement with the operating member 692 to reverse the condition of the contacts thereof for a purpose to be described below.

If the cover 686 is opened and the coupling bolt 578 is withdrawn sufficiently to bring the cap 632 into contact with one of the guide bushings 680 or 670, the rotation of the shutter 656 positions the bottom plate 660 thereof in the path of the tab 690, should a subsequent attempt be made to reclose the cover 686 without recoupling the drive lever 200 to the strut-driving shaft 568. Thus, the inability to close the cover 686 while the drive lever 200 and the strut-driving shaft 568 remain uncoupled provides a visual indication to maintenance or operating personnel that the operating mechanism 48 or 50 is incapable of operating the switches 40. An electrical indication of this fact may be derived from the inability of the tab 690 to engage the operating member 692 of the microswitch 694.

Between the back plate 658 of the shutter 656 and the forward portion of the lock stud 644 is a lock plate 696 mounted to the lower side wall 92 of the compartment 51. The lock plate 696 contains a pair of holes 700 and 702 aligned with the holes 664 and 666 in the back plate 658 of the shutter 656 and into which the guide bushings 668 and 670 extend. As the coupling bolt 578 is withdrawn from the drive lever 200, the cap 632 thereon first passes through one of the holes 700 or 702 before engaging one of the guide bushings 668 or 670. The entry of the cap 632 into one of the holes 700 or 702 occurs well prior to full disengagement of the conical head 580 of the coupling screw 578 from the conical hole 576 in the drive lever 200. Entry of the cap 632 into one of the holes 700 or 702 moves one of the guide bushings 668 or 670 out thereof and locks the strut-driving shaft 568 in its extant position, thus preventing movement of the insulative strut 62 and of the switch blades 60 during and after the time that the drive lever 200 is being uncoupled from the strut-driving shaft 568. As the cap 632 enters one of the holes 700 or 702, the conical head 580 is withdrawn from the hole 576 in the drive lever 200. Should there be any energy stored in the operating mechanisms 48 or 50 due to tension or compression of various elements thereof, such as push-pull rods 202, some slight degree of rotation of the drive lever 200 with respect to the conical head 580 may occur. This slight amount of relative rotation does not affect the position of the insulative strut 62 between the entry of the cap 632 into one of the holes 700 and 702. Where the lower-most portion 572 of the drive shaft 200 planar, prolonged frictional drag between the surface of the drive lever 200 and the head 580 of the coupling bolt 578 might damage, bend, or jam the bolt 578 or other elements of the coupling structure thus far described. The rounded surface of the conical head 580 and the dimple 574 are intended to avoid such deleterious effects. Specifically, because the surface of the dimple 574 is small, frictional drag thereby on the head 580 can occur only for a small amount of any rotation of the drive lever 200. This and the rounded shape of the conical head 580 are intended to decrease the duration and degree of frictional engagement between the head 580 and the drive lever 200.

Referring to FIG. 5B, if convenient, the shock absorbers 620 and 622, and various portions of the decoupling mechanism, including the shutter 656 and its associated elements, may be assembled in a single convenient subassembly 704.

Figure 23:
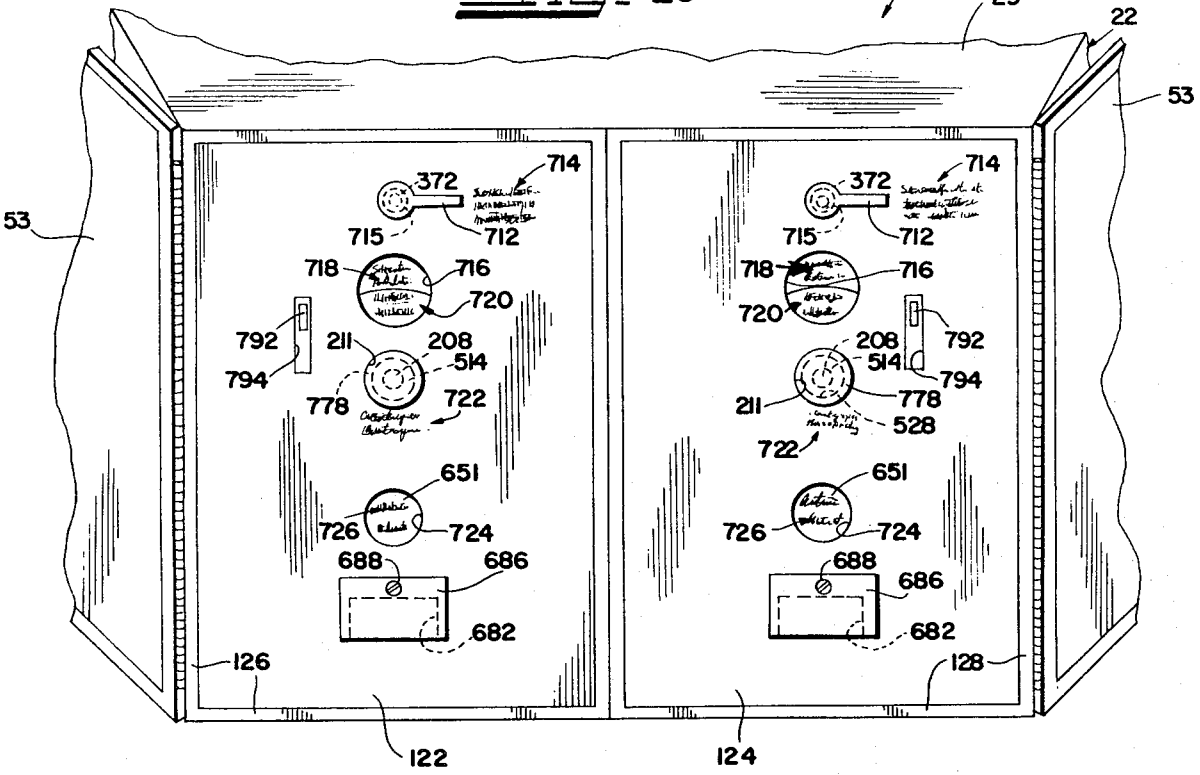
FIG. 23 is a view of switchgear according to the present invention, having the same general perspective as FIG. 5B but with the various portions of the operating mechanism depicted in their normal, accessible locations.

Indication and Control-FIG. 23

The various elements of the operating mechanisms 48 and 50 thus far described are normally enclosed behind the exterior side walls 122 and 124. Visible and accessible from the outside of the walls 122 and 124 after the doors 53 are opened are manual trip levers 712 with an appropriate legend 714 near thereto. The trip levers 712 are mounted to the shafts 372 via holes 715 through the walls 122 and 124. The legends 714 may instruct that upward or counterclockwise rotation of each manual trip lever 712 will close the switches 40 (if the springs 206 are charged to closed), whereas downward or clockwise rotation thereof will open the switches 40 (again, if the springs 206 are charged). Immediately beneath the manual trip levers 712 are windows 716 in the walls 122 and 124. Through the windows 716, in a manner to be described shortly, are visible legends 718 and 720 informing of both the position of the operating mechanisms 48 and 50, and the condition thereof. Specifically, one legend 718 may inform whether its operating mechanism 48 or 50 is in the "switch-closed" or "switch-open" position, while the other legend 720 may inform whether the spring 206 is charged (and capable of affecting the condition of the switches 40) or uncharged (and incapable of affecting the condition of the switches 40). Immediately below each window 716 are the holes 211 through the walls 122 and 124 through which there may be inserted the hand crank 210 as described above. Adjacent the holes 211 may be legends 722 informing that counterclockwise rotation of the hand crank 210 charges the spring 206 to open the switches 40 and that clockwise rotation of the crank 210 charges the spring 206 to close the switches 40.

Beneath each hole 211 is a window 724 through which may be observed legends 726. The legends 726 may inform whether the switches 40 are open or closed. Immediately beneath each window 724 is the cover 686 discussed above, which may be held in its normal closed position by the threaded fastener 688. As will be recalled, it is behind the cover 686 that the holes 664 and 666 are excessible for insertion of the tool 653 thereinto to decouple the operating mechanisms 48 and 50 from their respective switches 40.

The legends 726 visible through the window 724 are located on the portion 651 of the indicator plate 630. That is to say, as each strut-driving shaft 568 rotates, its indicator plate 630 rotates therewith, positioning either the "switch-open" or "switch-closed" legend 726 behind the window 724. Should the strut-driving shaft 568 be decoupled from the drive lever 200 by means of the coupling bolt 578, as described previously, not only does the coupling bolt 578 lock the insulative strut 62 in whatever position it occupies at the time of such decoupling, but also, the legend 726 visible through the window 724 remains unchanged even though following such decoupling the operating mechanisms 48 and 50 are exercised.

Referring again to FIGS. 7 and 8, the shaft 372 is supported for rotation in the mounting plates 310 and 328 and in the shaft support 373. Surrounding the shaft 372 and independently rotatable therefrom is an elongated tube 732 which is journaled for rotation on a bearing 734 mounted about the shaft 372 and on the bearing 374 in the shaft support 373. The forward end of the tube 732 carries an indicator plate 736 which rotates with the tube 732. It is the indicator plate 736 which bears the legends 718 which indicate the position—switch-open or switch-closed—of its operating mechanism 48 or 50.

Figure 19B:
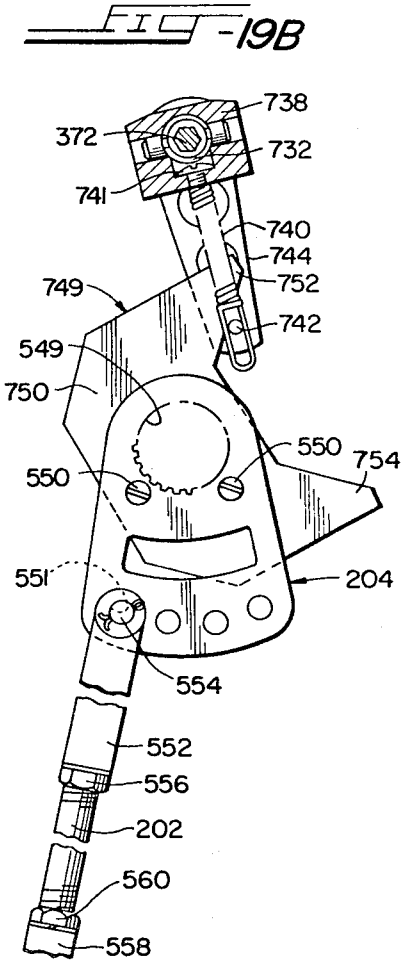
FIGS. 19A and 19B are, respectively, two possible configurations for a portion of a drive train for the operating mechanism of FIG. 5B and taken generally along line 19A in FIG. 7.
Figure 19A:
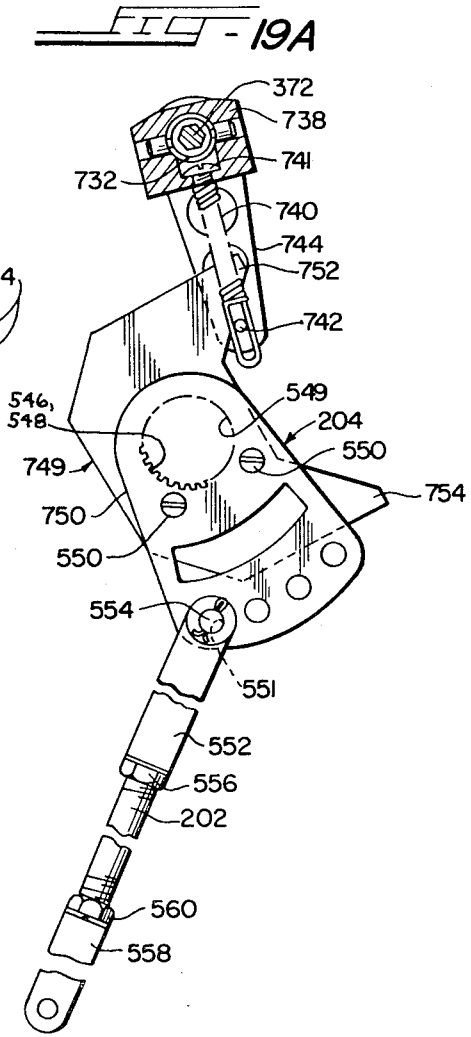

Attached to the rearward end of the tube 732 is a spring-mounting member 738 which rotates with the tube 732. Carried by, and depending from, the mounting member 738 is an elongated, wound spring 740 which acts as a shock absorbing lever, as described more fully below. One end of the spring 740 is attached to the mounting member 738 in any convenient manner, such as by a screw 741, while the other end of the spring is attached to a pin 742 carried at the lower end of a spring guide 744. The spring guide 744 is rotatable independently of the tube 732 by means of a bearing 746 surrounding the tube 732. Attached to the output hub 296 by the screws 550 which are run through the first output lever 204 and a collar 748 surrounding the hub 296 is an indicator driver 749. The indicator driver 749 comprises a plate-like member 750 having a pair of opposed extending arms 752 and 754 (FIGS. 7, 19A and 19B). The indicator driver 749 and the arms 752 and 754 thus rotate with the output levers 204 and 294.

Because of the robustness of the spring 206, rotation of the output lever 204 and 294 and, therefore, of the indicator driver 749 is quite rapid and involves high energy. The pin 742 lies in the path of rotation of the arms 752 and 754. Upon release of the high energy in the spring 206 in a rapid fashion, one of the arms 752 or 754 will rapidly impact with high energy on the pin 742. Such high impact moves the pin 742 either rightwardly or leftwardly at high velocity and at the same time both rotates the spring guide 744 freely above the tube 732 and deflects the spring 740 either rightwardly or leftwardly. Rapid deflection of the spring 740 stores energy therein which, as it "straightens" the spring 740, rotates the tube 732 and the indicator plate 736 either rightwardly or leftwardly to position on the appropriate legend 718—"switch operator in switch-closed position" or "switch operator in switch-open position'-'—behind the window 716. The use of the spring 740 acting as a lever permits the indicator plate 736 and the tube 732 to be simply constructed in non-robust fashion because the spring 740 dissipates the high impact energies involved with the movement of the indicator driver 749. Thus, the appropriate legend 718 is visible through the window 716, depending on whether the output levers 204 and 294 are in a position corresponding to that which they assume when the switches 40 are opened or closed and the operator 48 or 50 is coupled to the strut 62 or 64. Note that the legends 718 do not necessarily indicate the position of the switches 40, because, as it should be remembered, the operating mechanisms 48 or 50 may be decoupled from their respective switches 40. By matching the legends 718 to the legend 726 visible through the window 724, the operating mechanism 48 and 50 and the switches 40 may be conveniently recoupled following both decoupling thereof and exercising of the operating mechanisms 48 and 50.

Figure 20:
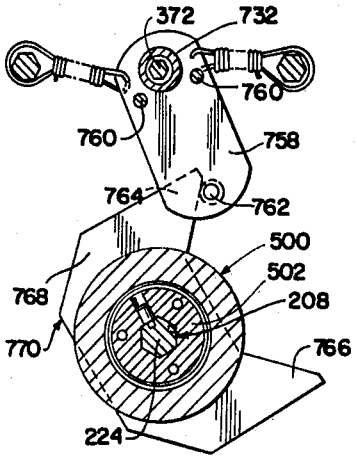
FIG. 20 represents a portion of the operating mechanism of FIG. 7 taken generally along line 20—20 therein.
Figure 21:
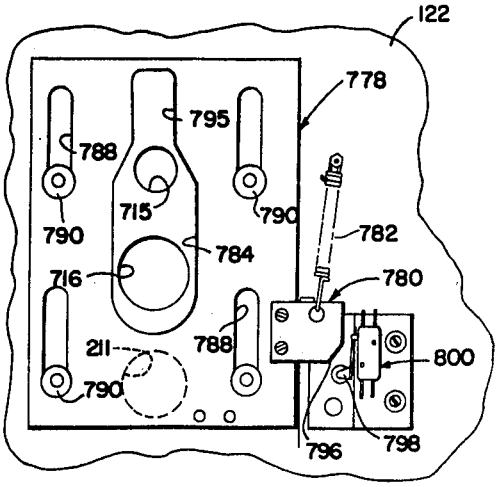
FIG. 21 represents a portion of the switchgear of FIG. 1 and is taken generally along line 21—21 therein.

Referring to FIGS. 7 and 20, an indicator plate 756 behind the plate 736 surrounds the tube 732 for independent rotation therefrom. Connecting the indicator plate 756 to an idler 758 also surrounding, and independently rotatable from, the tube 732 are a pair of rigid elongated pins 760. The indicator plate 756, therefore, rotates with the idler 758 via the pins 760. The lower end of the idler 758 carries a pin 762. The pin 762 lies in the rotative path of arms 764 and 766 carried by a plate-like body member 768 of an indicator driver 770. The indicator driver 770 is attached in any convenient fashion to the input shaft 208, such as by attachment with screws to the rear of the bushing 502. Thus, the indicator driver 770 rotates with the input shaft 208 regardless of whether such shaft is rotated by the hand crank 210 or by the motor 212. As the input shaft 208 rotates, one or the other of the arms 764 or 766 abuts the pin 762 and rotates the idler 758 either clockwise or counterclockwise. Such rotation of the idler 758 rotates the indicator plate 756 therewith to position an appropriate one of the legends 720 for observation through the window 716. The legends 720 inform of the condition— charged or uncharged—of the spring 206 which, of course, is dependent upon rotation of the input shaft 208 and on whether the output levers 204 and 294 have been rotated to operate the switches 40. Because the speed of movement of the input shaft 208 is much slower than that of the output levers 204 and 294, the indicator driver 770 moves much slower than the indicator driver 749 and an arrangement such as that involving the use of the spring 740 as a shock absorbing member is unnecessary.

Referring to FIG. 9, the indicator plate 736 is a sector-shaped member having a window 772 formed therethrough. Immediately beneath the window 772, the indicator plate 736 has a downward extension 774. To the left of the window 772, the plate 736 carries a legend 718*a* to the effect that "the operator is in the switch-closed position." Beneath the window 772 on the extensions 774, the indicator plate 736 carries a legend 718*b* to the effect that "the operator is in the switch open position." The indicator plate 756 is also sector-shaped and contains two legends 720*a* to the effect that "the spring 206 (or the operator 48 or 50) is charged" and two legends 720*b* to the effect that "the spring 206 (or the operator 48 or 50) is discharged." One of the legends 720*a* and one of the legends 720*b* are carried by the plate 756 so that they may be observed through the window 772 in the plate 736 and the window 716. The other legends 720*a* and 720*b* are located in reverse manner near the outer periphery of the plate 756 behind the path taken by the extension 774.

Thus, there are available for viewing through the window 716 various combinations of the legends 718 and 720. For example, an observer may be informed that the output levers 204 and 294 are in the switch-closed position and that the spring 206 is charged. This informs that the energy of the spring 206 may be released to open the switches 40. If, on the other hand, there is observable through the window 716 legends 718 and 720 which inform that the output lever 204 and 294 are in the switch-closed position, but that the spring 206 is discharged, an observer is informed that some action must be taken to charge the spring 206 before the switches 40 can be opened. Similar combinations of the legends 718 and 720 are available to inform that the output levers 204 and 294 are in the switch-closed position and that the spring 206 is either charged or discharged.

Referring to FIGS. 1, 7, 21 and 23, mounted and keyed to the shaft is an elongated guide block 776. Mounted to the inside of the walls 122 and 124 behind the holes 211 are movable slides 778 carrying a tab 780. Springs 782 are connected between the tabs 780 and the walls 122 and 124 to maintain the slides 778 in a normal upward position. Each slide 778 also includes an elongated slot 784 therethrough. The slot 784 is sufficiently long so that when the slide 778 is held in its normal upward position by the spring 782, both the holes 715 through the walls 122 and 124 for connection of the manual trip levers 712 to the shafts 372 and the windows 716 are unobstructed. However, the holes 211 for the hand crank 210 are blocked by a lower portion of the slide 778 when such is in the full upward position. Each slide 778 also includes mounting slots 788 in which ride headed pins 790 affixed to the walls 122 and 124. The pins 790 hold and guide the sliders 778 when they are moved upward or downwardly by or against the action of the springs 782. Each slide 778 is movable to a downward position by an arm 792 thereon which extends out of a slot 794 through the walls 122 and 124. Should it be desired to engage the hand crank 210 with the input shaft 208, the arm 792 must be pressed downwardly to move the slot 784 downwardly until the hole 211 for the hand crank 210 is uncovered. At this point, (1) a narrowed portion 795 of the slot 794 engages both sides of the guide block 776 preventing the shaft 372 from rotating and (2) the hand crank 210 may be engaged with the input shaft 208 to charge the spring 206, as described above. As soon as the hand crank 210 is removed from the hole 211, the spring 782 returns the slide 778 to its normal position.

A portion of each tab 780 serves as a cam 796. Each cam 796 is designed to operate the operating member 798 of a microswitch 800 mounted to the inside of the wall 122 or 124. Thus, when the slide 778 is moved downwardly to permit insertion of the hand crank 210 through the hole 211 therefor, the normal state of the contacts of the microswitch 800 is reversed due to contact between the cam 796 and the operating member 798. The function of the microswitch 800 is described below.

Automatic Operation

Figure 22:
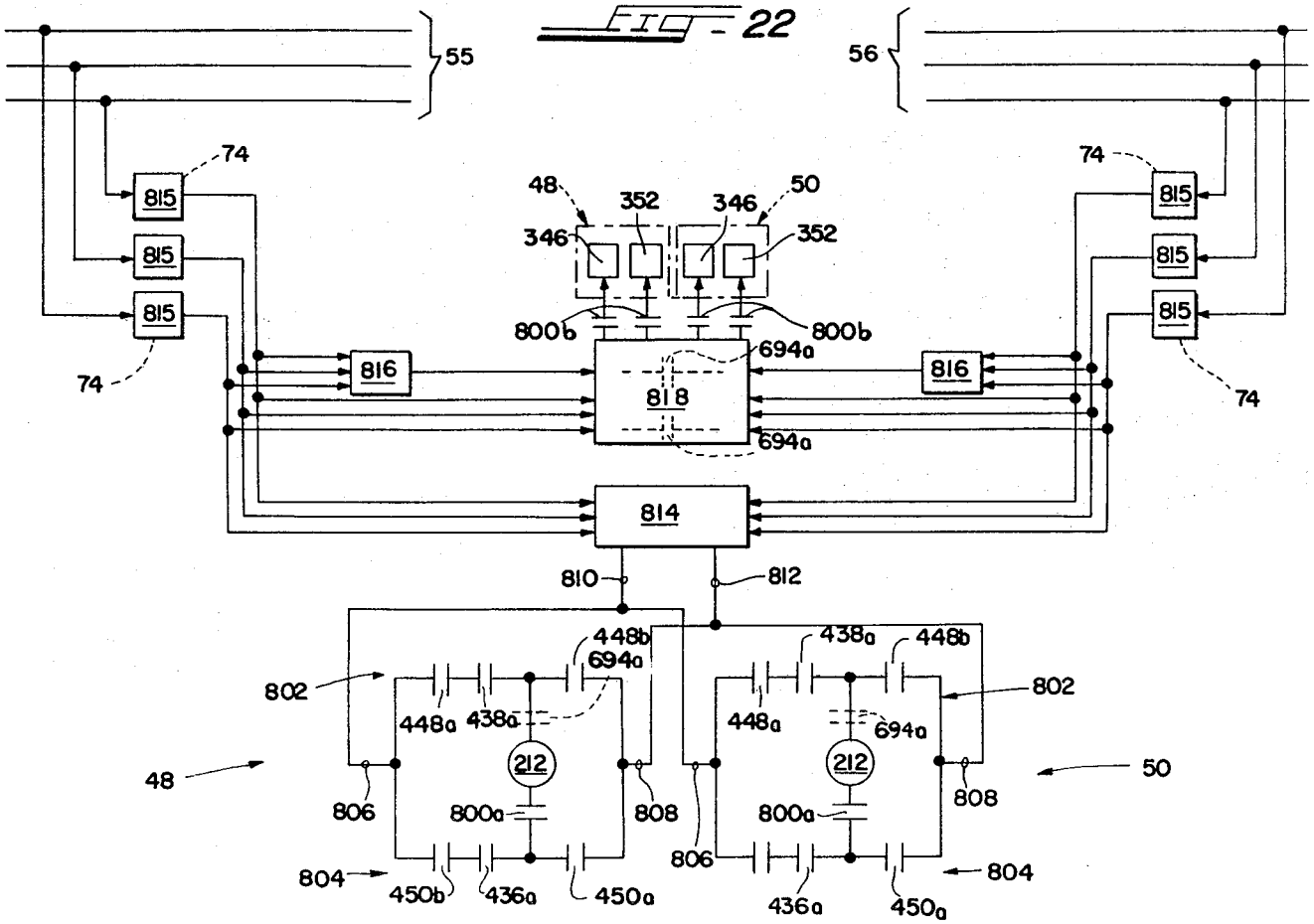
FIG. 22 is a general electrical schematic of a circuit which effects overall control of the operating mechanism according to the present invention.

Referring now to FIG. 22, there is shown a generalized schematic circuit for automatically operating the switchgear 20 of the present invention. It is to be understood that other circuit arrangements may be devised by those skilled in the art and that the schematic of FIG. 2 is exemplary only. The description of FIG. 22 is given in combination with further consideration of FIGS. 8, 15, and 21.

As described previously, each operator 48 and 50 contains a motor 212; only the motor 212 for the operator 48 and the circuit therefor are described here. Each motor 212 is of the type which is operable to rotate either clockwise or counterclockwise, depending on the direction of the current taken therethrough. For purposes of the present discussion, it will be assumed that the motor 212 rotates in a counterclockwise direction to rotate the first and second sprockets 214 and 216 in a counterclockwise direction when a downward current, as shown in FIG. 22, flows through the motor 212. Similarly, when an upward current flows through the motor 212, the first and second sprockets 214 and 216 are rotated in a clockwise direction.

The motor 212 is connected to a first branch circuit 802 and through a contact pair **800*a* to a second branch circuit 804. The contact pair 800*a* is controlled by the microswitch 800 and, as noted earlier, the condition thereof depends upon the position of the slide 778 which permits or prevents both insertion of the hand crank 210 to manually charge the spring 206 and operation of the manual trip lever 712 to release energy from the spring 206. For the time being, it will be assumed that the slide 778 is in its upward position and that the contact pair 800*a*** is closed.

To the left of the connection of the motor 212 to the first branch circuit 802 are two series contact pairs **448*a* and 438*a*. The contact pair 448*a* is contained within the microswitch 448*a* and is closed when the roller 332 is not within the notch 308 of the second output lever 294, but is open when the roller 332 is within the notch 308. The contact pair 438*a* is within the microswitch 438 and is closed at all times, except when the latch block 424 is within the notch 286 of the input lever 268. A contact pair 448*b* is to the right of the connection of the motor 212 to the first branch circuit 802. The contact pair 448*b* is within the microswitch 448 and is closed when the roller 332 is within the notch 308** and is open at all other times.

The second circuit branch 804 contains two series contact pairs **450*b* and 436*a* to the left of the connection of the motor 212 to the second circuit branch 804 and a pair of contacts 450*a* to the right thereof. The contact pair 450*b* is within the microswitch 450 and is closed whenever the roller 340 is not within the notch 308 of the second output 294, but is open whenever such roller 340 is within the notch 308. The contact pair 436*a* is within the microswitch 436 and is open only when the latch block 414 is within the notch 288 of the input lever 268 and is closed at all other times. The contact pair 450*a* is also in the microswitch 450 and is closed only when the roller 340 is within the notch 308**, being open at all other times.

The left sides of the first and second circuit branches 802 and 804 are connected to a conductor 806. The right sides of the circuit branches 802 and 804 are connected to a conductor 808. Assuming that a potential difference exists between the conductors 806 and 808, the following operation of the motor 212 takes place.

When the quick-break/quick-make mechanism 130 is in the condition depicted in FIG. 8, the switches 40 operated thereby are closed, as previously described, and the spring 206 is uncharged. The latch block 414 is not in the notch 288 because of the action of the kicker 432 and, accordingly, the contact pair **436*a* is closed. The roller 332 is not in the notch 308 and, as a consequence, the contact pair 448*a* is closed, while the contact pair is open. The latch block 424 is not in the notch 286 and, as a consequence, the contact pair 438*a* is closed. The roller 340 is located within the notch 308 and, accordingly, the contact pair 450*a* is closed, while the contact pair 450*b* is open. Because the contact pairs 448*a*, 438*a* and 450*a* are closed, current flows down through the motor 212 and, as discussed previously, the motor 212 rotates the first and second sprockets 214 and 216 in a counterclockwise direction. Counterclockwise rotation of the second sprocket 216 rotates the input shaft 208 in a counterclockwise direction to charge the spring 206. Current continues to flow down through the motor 212 as the spring 206 is charged until the latch block 424 enters the notch 286, at which point the contact pair 438***a* opens and the current flow through the motor 212 ceases. The spring 206 is now fully charged to subsequently open the switches 40 operated by the operating mechanism 48.

Subsequent removal of the roller 340 from the notch 308 permits the output levers 204 and 294 to rotate counterclockwise as the spring 206 discharges, opening the switches 40. Removal of the roller 340 from the notch 308 results in the contact pair 450*a* opening and the contact pair 450*b* closing. No current flows in the motor 212 at this time, however, because although the contact pairs 450*b* and 436*a* are closed, the contact pair 448*b* remains open. As the output levers 204 and 294 move to their full counterclockwise position, the roller 332 enters the notch 308 causing the contacts 448*b* to close and the contacts 448*a* to open. Further, the counterclockwise rotation of the second output lever 294 removes the latch block 424 from the notch 286 through the action of the kicker 434. This effects closure of the contact pair 438*a*. Because the contact pairs 450*b*, 436*a*, and 448*b* are all closed, current flows upwardly through the motor 212. As described previously, the upward flow of current through the motor 212 causes the motor to rotate the first and second sprockets 214 and 216 in a clockwise direction, rotating the input shaft 208 clockwise to charge the spring 206 for a subsequent closing operation of the switches 40 operated by the operating mechanism 48. The upward flow of current through the motor 212 continues until the latch block 414 enters the notch 288, opening the contact pair 436*a* and stopping the flow of current through the motor 212, at which point the spring 216 is fully charged. Should the roller 332 be subsequently removed from the notch 308, permitting discharge of the spring 206 and reclosure of the switches 40 operated by the mechanism 48, the contact pair 448*b* opens and the contact pair 448*a* closes, but current does not yet flow through the motor 212 because the contact pair 450*a* does not close until the roller 340 again enters the notch 308, at which time current again flows downwardly through the motor 212 to recharge the spring 206.

The operation of the contact pairs associated with the operator 50 and its motor 212 is not here described as it is similar to that just described for the contact pairs associated with the motor 212 of the operating mechanism 48.

In series of the motor 212 with the operating mechanism 48 may be the contact pair 800*a*. This contact pair 800*a* is associated with the microswitch 800, the condition of which is controlled by the position of the slide 778. Specifically, with the slide 778 in its normal upward position, the hole 211 for the hand crank 210 is blocked, the manual trip lever 712 is operable, and the contact pair 800*a* is closed. With the contact pair 800*a* closed, the motor 212 may operate to charge the spring 206 for opening or closing the switches 40, as described immediately above. If, however, the slide 778 is moved downwardly to expose the hole 211, preparatory to insertion of the hand crank 210, then the contact pair 800*a* opens. Opening of the contact pair 800*a* prevents the motor 212 from becoming energized, regardless of the state of the other contact pairs associated with the motor 212, thus preventing rotation of the second sprocket 216 from interfering with manual charging of the spring 206 by the hand crank 210.

The conductors 806 and 808, across which a potential difference is applied, may be connected to output conductors 810 and 812 of a power supply 814. The power supply 814 may be energized by, or form a portion of, voltage sensors 815 contained within the insulators 74, the insulator-voltage-sensor 74–815 being of the type described in commonly-assigned U.S. Pat. No. 4,002,976. As described in that patent, the integrated insulator-voltage-sensor 74–815 may provide, on an electrical output thereof, signals which are proportional to the voltages on the phases of the preferred source 55, which signals may provide power for other circuit elements, such as via the power supply 814 and may be utilized by sensing or logic devices in making decisions concerning the need to change the condition of the switches 40. Such decision-making circuits, connected to the output of the voltage sensors 815 contained within the insulators 74, may include a voltage unbalance detector 816 of the type described and claimed in commonly-assigned U.S. patent application, Ser. No. 957,267, filed Nov. 3, 1978. The output of the voltage unbalance detector 816, as well as the outputs of the voltage sensors 815 contained within the insulators 74, may all be fed to a logic and decision-making circuit 818, which, based on information received concerning the status of the phase conductors of the preferred source 55 and of the alternate source 56, selectively energizes the selonoids 346 and 352 of the operating mechanisms 48 and 50. For example, the logic and decision-making circuit 818 may receive information that one or more phase conductors of the preferred source 55 has no voltage (or an improper voltage) thereon. As a consequence, a decision needs to be made whether or not opening of the switches 40 associated with the preferred source 55 and closure of the switches 40 associated with the alternate source 56 needs to be effected. The circuit 818, having determined that something untoward is occurring at the preferred source 55, may also examine the status of the alternate source 56. If the alternate source 56 is capable of energizing the loads 58 connected to the switchgear 20, the switches 40 associated with the preferred source 55 may be opened by the operating mechanism 48 (by energization of the solenoid 352 therein) and the switches 40 associated with the alternate source 56 may be closed (by the energization of the solenoid 346) by the operating mechanism 50. If, on the other hand, the preferred source 56 is incapable, for any reason, of energizing the loads 58, the circuit 818 may make a decision to merely open the switches 40 associated with the preferred source 55 and to permit the switches 40 associated with the alternate source 56 to remain open. Various other decisions and combinations thereof, of course, can be made by the circuit 818, as should be obvious to those skilled in the art.

The microswitches 800 also preferably have two second pairs of normally closed contacts 800*b* in series with the solenoids 346 and 352 of the mechanisms 48 and 50. When the slide 778 is pulled down to enable manual charging of the spring 206 by the crank 211, these contacts 800*b* open to prevent operation of the solenoids 346 and 352 until the slide 778 is moved up by the spring 782. In this way removal of the rollers 332 or 340 from the notch 308 in the second output lever 294 by the solenoids 340 and 352 is prevented.

A contact pair 694*a* of the microswitch 694 is depicted in phantom both in association with the motors 212 of the operating mechanisms 48 and 50, and with the circuit 818. The reason for showing the contact pair 694*a* in both locations follows. The contact pair 694*a* may be normally closed, being open only when the cover 686 is opened to gain access to the coupling bolt 578. As depicted in FIGS. 22, one exemplary use of the normally closed contact pair 694*a* is to effect de-energization of the motor 212 upon opening the cover 686 by association with the motor 212 similar to that involved with the contact pair 800*a*. It may also be desired to associate the contact pair 694*a* with the circuit 818 to permit the circuit 818 to make a decision based on the open or closed state of the contact pair 694*a* or to otherwise cause the circuit 818 to give an indication, visual or otherwise, that the cover 686 is open and that the operating mechanisms 48 or 50 may not be coupled to their respective switches 40. Further, the contact pairs 694*a* and 800*a* may, when open, totally prevent automatic operation, for example, by disabling the circuit 818, the solenoids 346 and the motor 212.

Conclusion

In the high-voltage switchgear 20 of the present inventions, the switches 40 thereof are operable both automatically in response to the condition of the preferred source 55 and the alternate source 56 and manually by selective operation of the manual trip lever 712. Further, the springs 206 of the operating mechanisms 48 and 50, the release of energy from which effects operation of the switches 40, may be either automatically charged following operation of the switches 40, as dictated by the circuit 818, or may be manually charged as desired by appropriate manipulation of the hand crank 210. Also, the operating mechanisms 48 and 50 may be decoupled from their switches 40, which are locked in position thereby, to permit such the mechanisms 48 and 50 to be exercised, tested or maintained without affecting the conditions of the switches 40. The switchgear 20 also may selectively prevent the operating mechanisms 48 and 50 from being operated by the manual trip lever 712 when the hand crank 210 is used to charge the spring 206, and also, prevent the motor 212 from attempting to charge the spring 206 when the hand crank 210 is used. Additionally, when the cover 686 is opened, preparatory to decoupling the operating mechanisms 48 and 50 from the switches 40, various consequences may ensue, such as the prevention of operation of the motor 212 or the giving of a visual or other indication that the operating mechanisms 48 and 50 may not be coupled to their respective switches 40. Moreover, the various legends 714, 718, 720, 722 and 726 completely inform operation personnel of the conditions of both the operating mechanisms 48 and 50 and of the switches 40 associated therewith. This information permits such operating personnel to determine what action, if any, is necessary regarding operation of the switchgear 20.

Additional features of the switchgear 20 of the present invention include:

(1) Construction of the switch assemblies 32 and 34 as integral, back-to-back units separate from the enclosure 22 and including the integral compartments 51 and 52 for the operating mechanisms 48 and 50;

(2) Isolation of the compartments 51 and 52 (at low voltage) from the switch compartments 24 and 26 (at high voltage) by the integral construction set forth in (1), above, including the various walls 92, 94, 105, 106, 107, 115, 116 and 117 of the compartments 51 and 52;

(3) Operating mechanisms 48 and 50 which use common, interchangeable parts and the quick-break/quick-make mechanisms 130 of which exhibit the same "handedness" in operating their switches 40 in mirror-image fashion, the latter being achieved by a slight difference in the connection of the mechanisms 130 to the drive levers 200;

(4) A single manual trip lever 712 for each mechanism 48 and 50 by which the switches 40 can be opened or closed, depending on the direction of rotation of the levers 712;

(5) Physical prevention of the operation of the trip levers 712 while the springs 206 are being charged either by the motors 212 (due to the action of the cam 282, the blocking arm assembly 376 and the blocking shuttle 380) or manually by the crank 210 (due to the action of the guide block 776 and the slide 778, as well as of the elements 282, 376 and 380);

(6) The location of the legends 718 and 720 near the manual trip lever 712, the shaft 372 for which provides the support for the elements which operate the indicator plates 736 and 749 bearing such legends 718 and 720;

(7) The inability of operation of the latch assemblies 320 and 322 to interfere with or affect the operation or position of the manual trip levers 712, and vice versa, due to the action of the levers 324 and 336 and of the slots 364 and 366 therein;

(8) The de-energization of the motors 212 by the same latch assemblies 408 and 410 which hold the input lever 268 after the springs 206 arc charged by rotation thereof as the motors 212 are energized;

(9) The ability to decouple the mechanisms 48 and 50 from their switches 40, yet to keep associated with the high-speed, high-energy moving parts thereof (e.g., the drive levers 200) the shock absorbers 620 and 622 which permit the mechanisms 48 and 50 to be "exercised" with dissipation of the high-energy such that damage thereto is obviated;

(10) The ability to decouple the mechanisms 48 and 50 from their switches 40 while both simultaneously locking the switches 40 in their extant positions and permitting energy stored in the mechanisms 48 and 50 to be released without damage thereto;

(11) Prevention of recoupling the mechanisms 48 and 50 to their switches 40 while uncomplementary positions obtain due to the necessary relationship between the coupling bolt 578 (which may be in one of two rotative positions of the strut-driving shaft 568) and the single hole 576 in the drive lever 200; and

(12) Physical, visual evidence provided by the inability to close the cover 686 that the mechanisms 48 and 50 are uncoupled from their switches 40 due to the actions of the shutter 656 and the tab 690.

It is to be understood that the above-described embodiments of the present invention are simply illustrative of the principles thereof. Various modifications and changes may be devised by those skilled in the art which embody the principles of this invention, yet fall within the spirit and scope thereof.

We claim:

1. Improved high-voltage switchgear of the type having a switch selectively operable between a closed position and an open position and a switch-operating mechanism which can assume a switch-closed or a switch open condition due to the action of means therein for storing a predetermined amount of mechanical energy capable, upon release thereof, of closing or opening the switch, wherein the improvement comprises:

first electrical means for re-storing the predetermined amount of energy in the energy storing means in response to, and after, the release of energy previously stored therein, the re-stored energy being capable of placing the operating mechanism in the condition opposite that assumed by the operating mechanism during the release of the previously stored energy;

first mechanical means responsive to selective manual manipulation thereof for re-storing the predetermined amount of energy in the energy storing means after the release of energy previously stored therein, the re-stored energy being capable of placing the operating mechanism in the condition opposite that assumed by the operating mechanism during the release of the previously stored energy;

second electrical means for releasing energy stored in the energy storing means;

second mechanical means for releasing energy stored in the energy storing means in response to selective manual manipulation thereof;

first preventing means responsive to the ongoing restoration of energy in the energy storing means by either the first electrical means or the first mechanical means for preventing the release of any energy by the second mechanical means until the predetermined amount of energy is restored;

second preventing means responsive to the ongoing restoration of energy in the energy storing means by the first mechanical means for preventing both (a) the re-storing of energy in the energy storing means by the first electrical means and (b) the release of any energy in the energy storing means by the second electrical means, at least until the predetermined amount of energy is re-stored;

means responsive to selective manual manipulation thereof for coupling the operating mechanism to or decoupling the operating mechanism from the switch whether or not energy is stored in the energy storing means and regardless of the condition of the operating mechanism;

means responsive to the decoupling of the operating mechanism from the switch for dissipating energy stored in the operating mechanism and for preventing damage to the switch and to the operating mechanism by such dissipated energy; and means (a) responsive to an ongoing attempt to decouple the operating mechanism from the switch for locking the switch in its extant position before decoupling is completed and (b) responsive to an ongoing attempt to couple the operating mechanism to the switch to permit its unlocking the switch for movement by the operating mechanism out of its extant position after coupling is completed.

2. The switchgear of claim 1, which further comprises:

means responsive to partial or complete decoupling of the operating mechanism from the switch for giving a sensible indication that coupling between the operating mechanism and the switch is not completed.

3. The switchgear of claim 1, wherein:

the second mechanical means comprises a rotatable trip shaft;

a manipulable trip lever on the trip shaft for rotating the trip shaft;

a first latch for normally preventing the release from the energy storing means of energy tending to place the operating mechanism in one of its conditions;

a second latch for normally preventing the release from the energy storing means of energy tending to place the operating mechanism in its other condition;

a first arm on the trip shaft rotatable therewith; and link means for connecting the first arm to the first and second latches for (a) disabling the first latch in response to rotation of the lever, shaft and arm in one direction to release energy which is stored in the storing means and which tends to place the operating mechanism in its one condition, and (b) disabling the second latch in response to rotation of the lever, shaft and arm in an opposite direction to release energy which is stored in the storing means and which tends to place the operating mechanism in its other condition.

4. The switchgear of claim 3, wherein:

the second electrical means comprises a first electrical actuator means responsive to energization thereof for disabling the first latch to release energy which is stored in the storing means and which tends to place the operating mechanism in its one condition; and a second electrical actuator means responsive to energization thereof for disabling the second latch to release energy which is stored in the storing means and which tends to place the operating mechanism in its other condition.

5. The switchgear of claim 4, wherein:

the first latch and the first electrical actuator means are unaffected by trip shaft rotation in the opposite direction;

the second latch and the second electrical actuator means are unaffected by trip shaft rotation in the one direction; and the shaft is not rotated by energization of either electrical actuator means.

6. The switchgear of claim 5, wherein:

the first latch includes a first center-pivotable latch lever, one end of which is pivotally connected to the first electrical actuator means and the other end of which is pivotally and slidably connected to the link means; and the second latch includes a second center-pivotable latch lever, one end of which is pivotally connected to the second electrical actuator means and the other end of which is pivotally and slidably connected to the link means.

7. The switchgear of claim 6, wherein:

the link means comprises a first link pivotally connected to the first arm;

a slot in the first link for permitting relative movement between the first link and the first latch lever when the first arm rotates in the opposite direction, an end of the slot engaging the first latch lever for pivoting thereof to disable the first latch when the first arm rotates in the one direction;

a second link pivotally connected to the first arm; and a slot in the second link for permitting relative movement between the second link and the second latch lever when the first arm rotates in the one direction, an end of the slot engaging the second latch lever for pivoting thereof to disable the second latch when the first arm rotates in the opposite direction.

8. The switchgear of claim 3, wherein:

the first preventing means comprises a second arm on the shaft rotatable therewith; and blocking shuttle means for preventing rotation of the second arm, the first arm, the shaft and the trip lever in response to the ongoing re-storing of energy in the storing means and for permitting rotation of the second arm when the predetermined amount of energy is re-stored in the energy means.

9. The switchgear of claim 8, wherein:

the blocking shuttle means comprises a member movable into and out of the path of rotation of the second arm, and cam means responsive to the ongoing re-storing of energy in the storing means for moving the member into the path of rotation of the second arm, and responsive to the re-storing of the predetermined amount of energy in the storing means for moving the member out of the path of rotation of the second arm.

10. The switchgear of claim 3, wherein:

the first mechanical means includes a tool-engageable input shaft rotatable in either direction to store energy in the storing means; and a plate slidable between a first position, whereat access to the input shaft by the tool is blocked, and a second position, whereat the input shaft is accessible for engagement by the tool; and the first preventing means comprises an elongated block on the trip shaft rotatable therewith; and means on the slidable plate for engaging and preventing rotation of the block when the plate is in its second position.

11. The switchgear of claim 10, wherein:

the second preventing means comprises switch means responsive to the slidable plate occupying its second position for preventing operation of the first and second electrical means.

12. The switchgear of claim 3, which further comprises:

first indicator means for giving a sensible indication of whether or not the predetermined amount of energy is stored in the storing means; and second indicator means for giving a sensible indication of whether the operating mechanism is in the switch-open or the switch-closed condition.

13. The switchgear of claim 12, wherein the operating mechanism further includes a rotatable output lever coupleable to the switch for rapid rotation between a switch-open and a switch-closed position upon release of the predetermined amount of stored energy; and wherein the second indicator means comprises an elongated tube surrounding, and freely rotatable about, the trip shaft;

an indicator plate on and transverse to the tube;

first indicia on the plate which when moved to an observable location inform that the operating mechanism has assumed one of its conditions;

second indicia on the plate which when moved to the observable location inform that the operating mechanism has assumed its other condition;

an elongated extension spring carried by, and transversely of, the tube; and a driver on the output lever which impacts against the extension spring from either side as the output lever rotates, such impact deflecting the spring to store energy therein, release of the energy as the spring becomes undeflected rotating the tube and the plate, the spring preventing transfer of significant energy from the driver to the tube.

14. The switchgear of claim 12, wherein the operating mechanism further includes an input lever, rotation of which in opposite directions stores energy in the storing means, and wherein:

the first indicator means comprises an indicator plate freely rotatable transversely about the trip shaft;

first indicia on the plate which when moved to an observable location inform that the predetermined amount of energy is stored in the storing means;

second indicia on the plate which when moved to the observable location inform that less than the predetermined amount of energy is stored in the storing means; and means for rotating the plate in response to rotation of the input lever.

15. The switchgear of claim 12, wherein the operating mechanism further includes a rotatable output lever coupleable to the switch for rapid rotation between a switch-open and a switch-closed position upon release of the predetermined amount of stored energy, and an input lever, rotation of which in opposite directions stores energy in the storing means, and wherein:

the second indicator means comprises an elongated tube surrounding, and freely rotatable about, the trip shaft;

a first indicator plate on and transverse to the tube;

first indicia on the first plate which when moved to an observable location inform that the operating mechanism has assumed one of its conditions;

second indicia on the first plate which when moved to the observable location inform that the operating mechanism has assumed its other condition;

an elongated extension spring carred by, and transversely of, the tube; and a first driver on the output lever which impacts against the extension spring from either side as the output lever rotates, such impact deflecting the spring to store energy therein, release of the energy as the spring becomes undeflected rotating the tube and the first plate, the spring preventing transfer of significant energy from the driver to the tube; and the first indicator means comprises a second indicator plate freely rotatable transversely about the tube;

third indicia on the second plate which when moved to the observable location inform that the predetermined amount of energy is stored in the storing means;

fourth indicia on the second plate which when moved to the observable location inform that less than the predetermined amount of energy is stored in the storing means; and means for rotating the second plate in response to rotation of the input lever.

16. The switchgear of claim 15, wherein:

the first plate is in front of the second plate at the observable location and the plates rotate in parallel planes;

the first plate has portions thereof removed through which the third and fourth indicia are observable at the observable location, depending on the rotative position of the input lever.

17. Improved high-voltage switchgear of the type having a switch selectively operable between a closed position and an open position and a switch-operating mechanism which can assume a switch-closed or a switch-open condition due to the action of means therein for storing a predetermined amount of mechanical energy capable, upon release thereof, of closing or opening the switch, wherein the improvement comprises:

first means responsive to selective manual manipulation thereof for coupling the operating mechanism to or decoupling the operating mechanism from the switch whether or not energy is stored in the energy storing means and regardless of the condition of the operating mechanism;

second means responsive to the decoupling of the operating mechanism from the switch for dissipating energy stored in the operating mechanism and for preventing damage to the switch and the operating mechanism by such dissipated energy; and third means (a) responsive to an ongoing attempt to decouple the operating mechanism from the switch for locking the switch in its extant position before decoupling is completed and (b) responsive to an ongoing attempt to couple the operating mechanism to the switch for unlocking the switch for movement by the operating mechanism out of its extant position after coupling is completed.

18. The switchgear of claim 17, which further comprises:

indicating means responsive to partial or completed decoupling of the operating mechanism from the switch for giving a sensible indication that coupling between the operating mechanism and the switch is not completed.

19. The switchgear of claim 17 or 18, wherein:

the first means comprises a first rotatable shaft connected to the switch;

a hollow second shaft mounted about a portion of the first shaft, the shafts being independently, generally coaxially rotatable;

a drive lever fixed to the outside of the second shaft;

means for rotating the drive lever in response to the release of energy from the storing means; and a coupling member carried by the first shaft and selectively manually movable between a first location, whereat it engages the first shaft and the drive lever, and a second location, whereat it engages the first shaft and is disengaged from the drive lever, the release of energy from the storing means while the coupling member is in its first location operating the switch, the release of energy from the storing means while the coupling member is in its second location rotating the second shaft and the drive lever but not affecting the switch or the rotative position of the first shaft.

20. The switchgear of claim 19, wherein:

the third means comprises a stationary lock plate means (a) engaged by the coupling member as it begins to move to, well before it reaches, its second location for locking the coupling member and the first shaft against rotation before the coupling member is disconnected from the drive lever, and (b) disengaged by the coupling member just before it completes movement to its first location for unlocking the coupling member and the first shaft for rotation after the coupling member is connected to the drive lever.

21. The switchgear of claim 20, wherein:

the second means comprises a hole in the drive lever, the coupling member being in the hole in its first location; and a dimple in the drive lever surrounding the hole, the dimple having a limited surface area, rotation of the drive lever as the coupling moves toward its second location permitting frictional drag between the coupling member and the drive lever to occur only for the time the coupling member is in engagement with the surface area of the dimple.

22. The switchgear of claim 21, wherein:

the second means further comprises a rounded head on the coupling member for entry into the hole in the drive lever, the roundness of the head reducing the degree of frictional drag between it and the dimple.

23. The switchgear of claim 21, wherein:

the coupling member comprises a two-headed bolt, a central portion of which is threaded;

an arm carried by the first shaft and having a threaded hole therein which receives the central portion of the bolt; and a pair of holes in the stationary lock plate means, the holes being respectively aligned with the hole in the drive lever depending on whether the drive lever is in the switch-open or the switch-closed position;

one head of the bolt engaging the hole in the drive lever and the other head of the bolt not engaging either hole in the lock plate when the coupling member is in its first location, the one bolt head not engaging the drive lever hole and the other bolt head engaging the lock plate hole which is aligned with the drive lever hole when the coupling member is in its second location.

24. The switchgear of claim 18, wherein:

the first means comprises a first rotatable shaft connected to the switch;

a hollow second shaft mounted about a portion of the first shaft, the shafts being independently, generally coaxially rotatable;

a drive lever fixed to the outside of second shaft;

means for rotating the drive lever in response to the release of energy from the storing means; and a tool-engageable coupling member carried by the first shaft and selectively movable by manipulation of a tool engaged therewith between a first location, whereat it engages the first shaft and the drive lever, and a second location, whereat it engages the first shaft and is disengaged from the drive lever, the release of energy from the storing means while the coupling member is in its first location operating the switch, the release of energy from the storing means while the coupling member is in its second location not affecting the switch; and the indicating means comprises an openable cover, which in a closed position prevents engagement of the coupling member by the tool; and means for preventing closure of the cover when the coupling member is out of its first location whether or not the tool is engaging the coupling member.

25. The switchgear of claim 24, wherein:

the preventing means comprises:

a tab on the cover for movement therewith; and a rockable member having a first normal position out of which it is moved by the onset of movement of the coupling member out of its first and toward its second location, the rockable member intercepting the path of movement of the tab when the rotatable member is not in its first position, so that interference between the tab and the rockable member prevents the cover from closing.

26. The switchgear of claim 24, which further comprises:

means for preventing movement of the coupling member between its locations unless the tool is engaged therewith.

27. The switchgear of claim 19, which further comprises:

an indicator plate transversely carried by the first shaft for rotation therewith; and indicia on the plate when when moved to an observable location inform whether the switch is open or closed depending on the rotative position of the first shaft.

28. The switchgear of claim 19, which further comprises:

shock-absorbing stop means for receiving the impact of the drive lever as the operating mechanism and the drive lever assume the switch-open and switch-closed conditions.

29. The switchgear of claim 28, wherein:

the shock-absorbing stop means and the first, second and third means are elements of an integral subassembly.

* * * * *